US010885840B2

(12) United States Patent
Yamaguchi

(10) Patent No.: US 10,885,840 B2
(45) Date of Patent: Jan. 5, 2021

(54) IMAGE DISPLAY APPARATUS

(71) Applicant: SHENZHEN TOREY MICROELECTRONIC TECHNOLOGY CO. LTD., Shenzhen (CN)

(72) Inventor: Masayuki Yamaguchi, Sakai (JP)

(73) Assignee: SHENZHEN TOREY MICROELECTRONIC TECHNOLOGY CO. LTD., Shenzhen (CN)

( * ) Notice: Subject to any disclaimer, the term of this patent is extended or adjusted under 35 U.S.C. 154(b) by 0 days.

(21) Appl. No.: 16/624,883

(22) PCT Filed: Mar. 26, 2018

(86) PCT No.: PCT/JP2018/012058
§ 371 (c)(1),
(2) Date: Dec. 19, 2019

(87) PCT Pub. No.: WO2018/235372
PCT Pub. Date: Dec. 27, 2018

(65) Prior Publication Data

US 2020/0135101 A1 Apr. 30, 2020

(30) Foreign Application Priority Data

Jun. 21, 2017 (JP) ..... 2017-121319

(51) Int. Cl.
*G09G 3/3233* (2016.01)

(52) U.S. Cl.
CPC ... *G09G 3/3233* (2013.01); *G09G 2320/0233* (2013.01); *G09G 2320/0271* (2013.01); *G09G 2320/0626* (2013.01); *G09G 2360/16* (2013.01)

(58) Field of Classification Search
CPC .. G09G 3/3233; G09G 3/3241; G09G 3/3225; G09G 3/30; G09G 3/20;
(Continued)

(56) References Cited

U.S. PATENT DOCUMENTS

2004/0150592 A1* 8/2004 Mizukoshi ..... G09G 3/3233 345/76
2007/0146252 A1 6/2007 Miller et al.
(Continued)

FOREIGN PATENT DOCUMENTS

JP 2009-521719 A 6/2009
JP 2009-216801 A 9/2009
(Continued)

*Primary Examiner* — Christopher E Leiby
(74) *Attorney, Agent, or Firm* — ScienBiziP, P.C.

(57) ABSTRACT

An image display apparatus includes: a region division unit that divides a display surface into a plurality of regions; a degree-of-influence calculation unit that calculates a first degree of influence representing a degree of influence of a brightness level of each of the regions on a brightness level of a respective region adjacent to the region; and a brightness correction unit that corrects a brightness level of each pixel. Influence of not only a location of connection in wiring in a display unit with an input terminal of a power supply for the display unit but also a wiring configuration of the display unit is reflected on the first degree of influence.

5 Claims, 11 Drawing Sheets

(58) Field of Classification Search
CPC ..... G09G 3/2003; G09G 2300/0426; G09G 2300/0842; G09G 2320/0233; G09G 2320/0223; G09G 2320/0285; G09G 2320/0626; G09G 2320/0271; G09G 2330/028; G09G 2330/021; G09G 2360/16; G09G 2360/144; H01L 27/32
See application file for complete search history.

(56) References Cited

U.S. PATENT DOCUMENTS

| | | | | |
|---|---|---|---|---|
| 2007/0269118 | A1* | 11/2007 | Sasaki | H04N 19/428 382/232 |
| 2008/0150969 | A1* | 6/2008 | Sagano | G09G 3/22 345/690 |
| 2009/0115718 | A1* | 5/2009 | Qiao | G09G 3/3611 345/102 |
| 2009/0225072 | A1 | 9/2009 | Mizukoshi et al. | |
| 2012/0044275 | A1 | 2/2012 | Kobayashi | |
| 2014/0062989 | A1* | 3/2014 | Ebisuno | G09G 3/3241 345/212 |
| 2016/0055780 | A1* | 2/2016 | Guo | G09G 3/2003 345/55 |
| 2016/0240140 | A1* | 8/2016 | Park | G09G 3/3258 |
| 2017/0140733 | A1* | 5/2017 | Park | G09G 5/10 |

FOREIGN PATENT DOCUMENTS

| | | | |
|---|---|---|---|
| JP | 2012-042611 | A | 3/2012 |
| WO | 2013/094104 | A1 | 6/2013 |

* cited by examiner

Rx, Ry, R0: RESISTOR
T: DRIVING TRANSISTOR
E: ORGANIC EL ELEMENT

FIG. 6

105: DISPLAY SURFACE

| | | m1 | m2 | m3 | m4 | m5 |
|---|---|---|---|---|---|---|
| | | X0 X1 X2 X3 X4 | X5 X6 X7 X8 X9 | X10 X11 X12 X13 X14 | X15 X16 X17 X18 X19 | X20 X21 X22 X23 X24 |
| n1 | Y0 Y1 Y2 Y3 Y4 | 255 | 127 | 85 | 63 | 51 |
| n2 | Y5 Y6 Y7 Y8 Y9 | 127 | 85 | 63 | 51 | 42 |
| n3 | Y10 Y11 Y12 Y13 Y14 | 85 | 63 | 51 | 42 | 36 |
| n4 | Y15 Y16 Y17 Y18 Y19 | 63 | 51 | 42 | 36 | 31 |
| n5 | Y20 Y21 Y22 Y23 Y24 | 51 | 42 | 36 | 31 | 28 |

X

Y

FIG. 7

105: DISPLAY SURFACE

| | X0 | X1 | X2 | X3 | X4 | X5 | X6 | X7 | X8 | X9 | X10 | X11 | X12 | X13 | X14 | X15 | X16 | X17 | X18 | X19 | X20 | X21 | X22 | X23 | X24 | BRIGHTNESS LEVEL TOTAL | DIFFERENCE |
|---|---|---|---|---|---|---|---|---|---|---|---|---|---|---|---|---|---|---|---|---|---|---|---|---|---|---|---|
| Y0 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 3200 | |
| Y1 | 128 | 128 | 128 | 128 | 128 | 128 | 128 | 255 | 255 | 255 | 255 | 255 | 255 | 255 | 255 | 255 | 255 | 255 | 255 | 128 | 128 | 128 | 128 | 128 | 128 | 4724 | 1524 |
| Y2 | 128 | 128 | 128 | 128 | 128 | 128 | 128 | 255 | 255 | 255 | 255 | 255 | 255 | 255 | 255 | 255 | 255 | 255 | 255 | 128 | 128 | 128 | 128 | 128 | 128 | 4724 | 0 |
| Y3 | 128 | 128 | 128 | 128 | 128 | 128 | 128 | 255 | 255 | 255 | 255 | 255 | 255 | 255 | 255 | 255 | 255 | 255 | 255 | 128 | 128 | 128 | 128 | 128 | 128 | 4724 | 0 |
| Y4 | 128 | 128 | 128 | 128 | 128 | 128 | 128 | 255 | 255 | 255 | 255 | 255 | 255 | 255 | 255 | 255 | 255 | 255 | 255 | 255 | 255 | 128 | 128 | 128 | 128 | 2525 | 2199 |
| Y5 | 128 | 128 | 128 | 128 | 128 | 128 | 128 | 255 | 255 | 255 | 255 | 255 | 255 | 255 | 255 | 255 | 255 | 255 | 255 | 255 | 255 | 128 | 128 | 128 | 128 | 2525 | 0 |
| Y6 | 128 | 128 | 128 | 128 | 128 | 128 | 128 | 255 | 255 | 255 | 255 | 255 | 255 | 255 | 255 | 255 | 255 | 255 | 255 | 255 | 255 | 128 | 128 | 128 | 128 | 2525 | 0 |
| Y7 | 128 | 128 | 128 | 128 | 128 | 128 | 128 | 255 | 255 | 255 | 255 | 255 | 255 | 255 | 255 | 255 | 255 | 255 | 255 | 255 | 255 | 128 | 128 | 128 | 128 | 2525 | 0 |
| Y8 | 128 | 128 | 128 | 128 | 128 | 128 | 128 | 255 | 255 | 255 | 255 | 255 | 255 | 255 | 255 | 255 | 255 | 255 | 255 | 255 | 255 | 128 | 128 | 128 | 128 | 2525 | 0 |
| Y9 | 128 | 128 | 128 | 128 | 128 | 128 | 128 | 255 | 255 | 255 | 255 | 255 | 255 | 255 | 255 | 255 | 255 | 255 | 255 | 255 | 255 | 128 | 128 | 128 | 128 | 2525 | 0 |
| Y10 | 128 | 128 | 128 | 128 | 128 | 128 | 128 | 255 | 255 | 255 | 255 | 255 | 255 | 255 | 255 | 255 | 255 | 255 | 255 | 255 | 255 | 128 | 128 | 128 | 128 | 2525 | 0 |
| Y11 | 128 | 128 | 128 | 128 | 128 | 128 | 128 | 255 | 255 | 255 | 255 | 255 | 255 | 255 | 255 | 255 | 255 | 255 | 255 | 128 | 128 | 128 | 128 | 128 | 128 | 4724 | 2199 |
| Y12 | 128 | 128 | 128 | 128 | 128 | 128 | 128 | 255 | 255 | 255 | 255 | 255 | 255 | 255 | 255 | 255 | 255 | 255 | 255 | 128 | 128 | 128 | 128 | 128 | 128 | 4724 | 0 |
| Y13 | 128 | 128 | 128 | 128 | 128 | 128 | 128 | 255 | 255 | 255 | 255 | 255 | 255 | 255 | 255 | 255 | 255 | 255 | 255 | 128 | 128 | 128 | 128 | 128 | 128 | 4724 | 0 |
| Y14 | 128 | 128 | 128 | 128 | 128 | 128 | 128 | 255 | 255 | 255 | 255 | 255 | 255 | 255 | 255 | 255 | 255 | 255 | 255 | 128 | 128 | 128 | 128 | 128 | 128 | 4724 | 0 |
| Y15 | 128 | 128 | 128 | 128 | 128 | 128 | 128 | 255 | 255 | 255 | 255 | 255 | 255 | 255 | 255 | 255 | 255 | 255 | 255 | 128 | 128 | 128 | 128 | 128 | 128 | 4724 | 0 |
| Y16 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 3200 | 1524 |
| Y17 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 3200 | 0 |
| Y18 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 3200 | 0 |
| Y19 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 3200 | 0 |
| Y20 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 3200 | 0 |
| Y21 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 3200 | 0 |
| Y22 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 3200 | 0 |
| Y23 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 3200 | 0 |
| Y24 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 128 | 3200 | 0 |
| BRIGHTNESS LEVEL TOTAL | 3200 | 3200 | 3200 | 3200 | 3200 | 3200 | 3200 | 5105 | 5105 | 5105 | 3544 | 3544 | 3544 | 3544 | 3544 | 3544 | 3544 | 3544 | 3544 | 2528 | 2528 | 3200 | 3200 | 3200 | 3200 | | |
| DIFFERENCE | | 0 | 0 | 0 | 0 | 0 | 0 | 1905 | 0 | 0 | 1561 | 0 | 0 | 0 | 0 | 0 | 0 | 0 | 0 | 1016 | 0 | 672 | 0 | 0 | 0 | | |

X

Y

IMAGE DISPLAY APPARATUS

TECHNICAL FIELD

The present invention relates to an image display apparatus.

BACKGROUND ART

Organic EL (Electro Luminescence) displays are known as a thin, high quality, and low power consumption display device. On each of these organic EL displays, a plurality of pixel circuits including organic EL elements that are self-luminous display elements driven by current and driving (control) transistors for driving the organic EL elements are arranged in a matrix form.

The current flowing to each organic EL element is decided by a corresponding one of the driving transistors, but the electric potential of the driving transistor is not necessarily constant. The driving transistor might have a voltage drop (IR drop) depending on resistance in wiring and the current flowing through the wiring line.

Since driving transistors corresponding to pixels with a high (bright) average gradation have high current flowing thereto, adjacent driving transistors that receive power from the same wiring line as that connected to the driving transistors with the high average gradation have a large voltage drop. This causes lowered brightness of pixels adjacent to pixels with a high average gradation, a change in the hue of a displayed image, pixels with a low gradation made black, and the like. A display device has a deteriorated display quality.

Hence, PTL 1 discloses a display device that corrects input pixel data by using correction data to reduce the influence of a voltage drop on the current. The display device disclosed in PTL1 corrects the pixel data while calculating the voltage drop in accordance with the order in which the pixel data items are supplied.

CITATION LIST

Patent Literature

PTL 1: Japanese Unexamined Patent Application Publication No. 2009-216801 (published on Sep. 24, 2009)"

SUMMARY OF INVENTION

Technical Problem

The display device disclosed in PTL 1 corrects the pixel data while calculating the voltage drop in accordance with the order in which the pixel data items are supplied. This causes a problem that it is not possible to correctly calculate a voltage drop depending on the wiring configuration of the display unit or the location of a power supply installed in the display unit and thus not possible to correct the pixel data appropriately.

An aspect of the present invention is provided to aim to appropriately correct pixel data regardless of the location of connection in wiring in a display unit with the input terminal of a power supply for the display unit and the wiring configuration of the display unit.

Solution to Problem

To solve the above-described problem, there is provided an image display apparatus according to an aspect of the present invention that displays an image on a display unit based on image data. The image display apparatus includes: a region division unit that divides a display surface of the display unit into a plurality of regions; a degree-of-influence calculation unit that calculates a first degree of influence representing a degree of influence of a brightness level of each of the regions on a brightness level of a respective region adjacent to the region, the regions resulting from the division by the region division unit; and a brightness correction unit that corrects a brightness level of each of pixels in the image data based on the first degree of influence. Influence of not only a location of connection in wiring in the display unit with an input terminal of a power supply for the display unit but also a wiring configuration of the display unit is reflected on the first degree of influence.

Advantageous Effects of Invention

An aspect of the present invention exerts an advantageous effect that pixel data can be appropriately corrected regardless of the location of the connection in the wiring in the display unit with the input terminal of the power supply for the display unit and the wiring configuration of the display unit.

BRIEF DESCRIPTION OF DRAWINGS

FIG. 6 is a view illustrating a degree of influence on each uniform region of the display surface of the display unit.

FIG. 7 is a view illustrating the brightness of each of pixels on the display surface of the display unit.

DESCRIPTION OF EMBODIMENTS

Embodiment 1

An embodiment of the present invention will be described based on FIGS. 1 to 11.

(Configuration of Image Display Apparatus 1)

Figure 1:
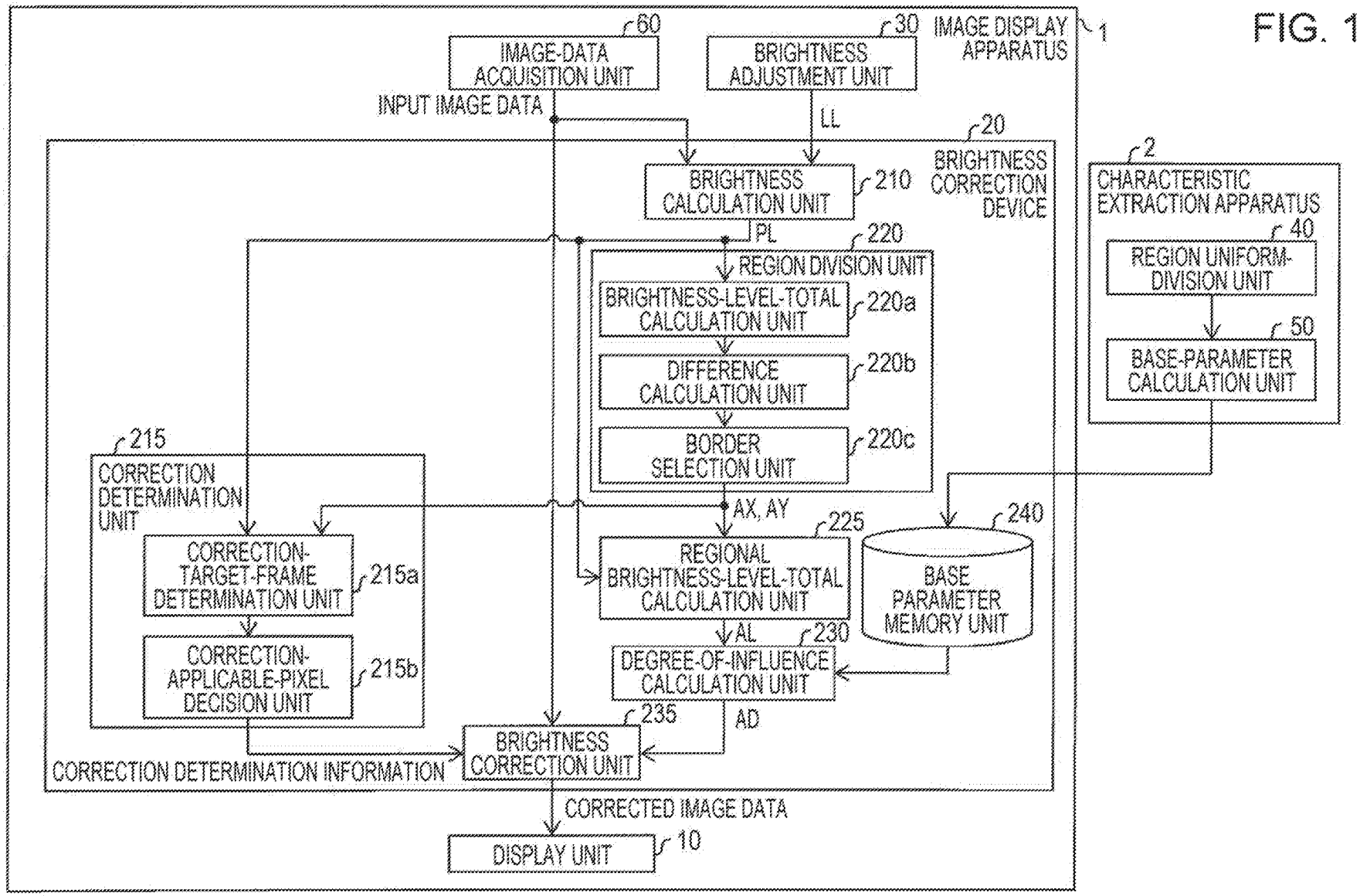
FIG. 1 is a block diagram illustrating the configuration of an image display apparatus according to Embodiment 1 of the present invention.

As illustrated in FIG. 1, an image display apparatus 1 includes a display unit 10, a brightness correction device 20, a brightness adjustment unit 30, and an image-data acquisition unit 60. FIG. 1 is a block diagram illustrating the configuration of the image display apparatus 1 according to Embodiment 1 of the present invention. The image display apparatus 1 displays an image on the display unit 10 based on image data. The brightness correction device 20 includes a brightness calculation unit 210, a correction determination unit 215, a region division unit 220, a regional brightness-level-total calculation unit 225, a degree-of-influence calculation unit 230, a brightness correction unit 235, and a base parameter memory unit 240 (memory unit).

The image-data acquisition unit 60 acquires input image data input in the image display apparatus 1. The image-data acquisition unit 60 supplies the acquired input image data to the brightness calculation unit 210 and the brightness correction unit 235.

The brightness adjustment unit 30 receives control information from a sensor and a host (not illustrated) in the image display apparatus 1. The brightness adjustment unit 30 outputs brightness control information LL. The brightness control information LL is information indicating the state of control data regarding an analog output voltage in the display unit 10 and is also information indicating a result of processing by an automatic contrast adjustment function included in the brightness adjustment unit 30. The control data regarding an analog output voltage is data regarding control by which an output voltage is changed to make a pixel brighter or darker even for the same gradation.

The brightness control information LL is information for deciding the degree of brightness, and this information is not fixed information but information varying in accordance with the system. In a case where a relationship between the gradation in the image data and brightness lowering caused by a degree of voltage-drop-influence AD is not changed, making the analog output voltage different in the display unit 10 causes the brightness control information LL to be constant. The brightness adjustment unit 30 is provided to adjust the brightness in the image data in accordance with the brightness of the surroundings of the image display apparatus 1. A method for detecting the brightness of the surroundings of the image display apparatus 1 may employ a light sensor but is not particularly limited thereto. The brightness adjustment unit 30 supplies the brightness control information LL to the brightness calculation unit 210.

Figure 2:
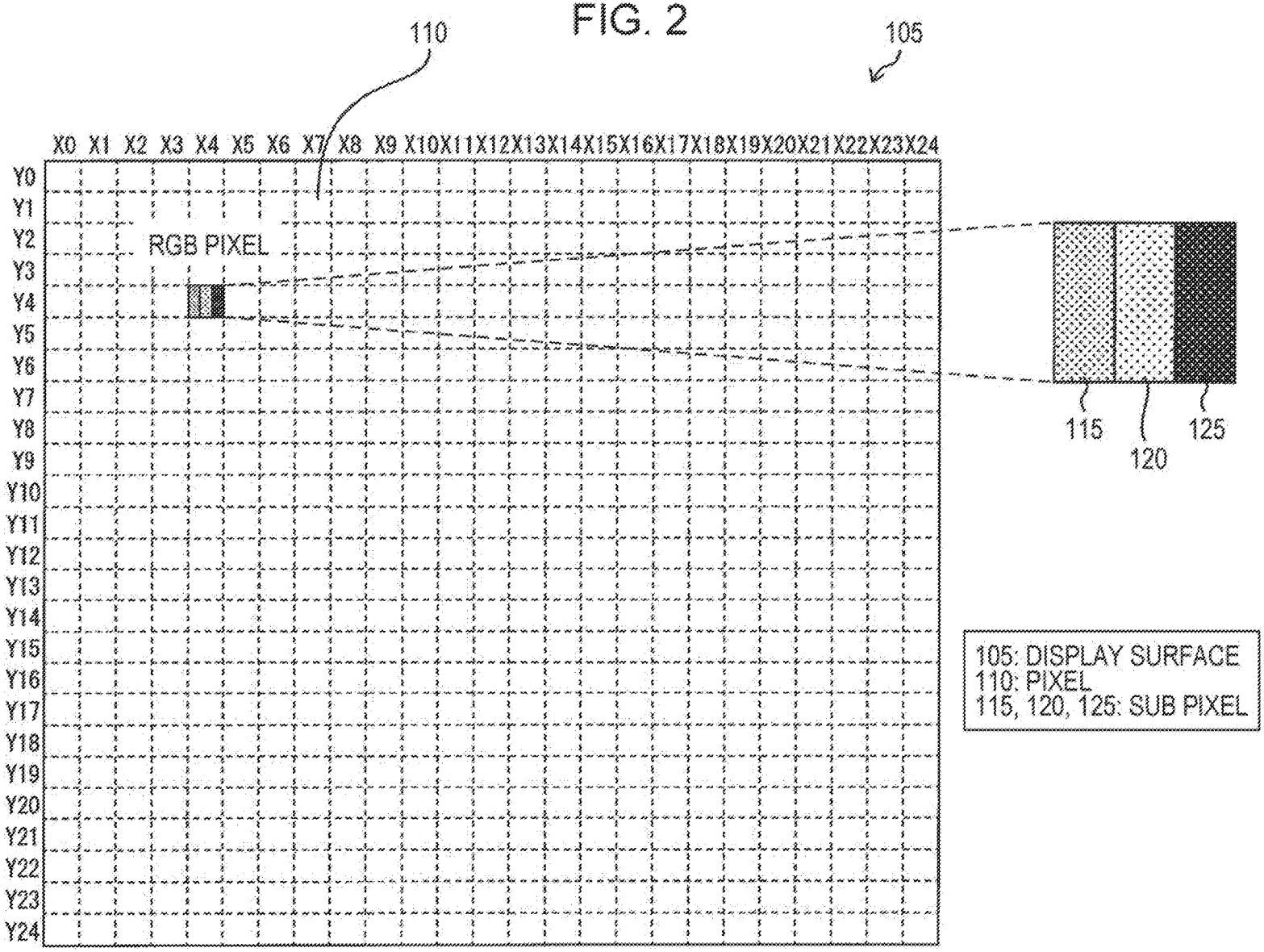
FIG. 2 is a schematic view illustrating the display surface of a display unit.

The display unit 10 is a display or a panel that displays an image. As illustrated in FIG. 2, 25×25 pixels 110 are arranged in a matrix form on a display surface 105 of the display unit 10. Each pixel 110 is composed of sub pixels 115, 120, and 125. FIG. 2 is a schematic view illustrating the display surface 105 of the display unit 10. The color of each sub pixel 115 is red, the color of each sub pixel 120 is green, and the color of each sub pixel 125 is blue. Processing performed in the RGB system in which one pixel is composed of sub pixels in three colors of red, green, and blue will herein be described.

Although the display surface 105 provided with the 25×25 pixels 110 is herein described for easy-to-understand explanation, general image display apparatuses include a display surface having pixels the number of which is larger than 25×25 that is the number of pixels. For example, an FHD (Full High Definition) panel has 1080×1920 pixels, and a WQHD (Wide Quad High Definition) panel has 1440×2560 pixels.

Figure 3:
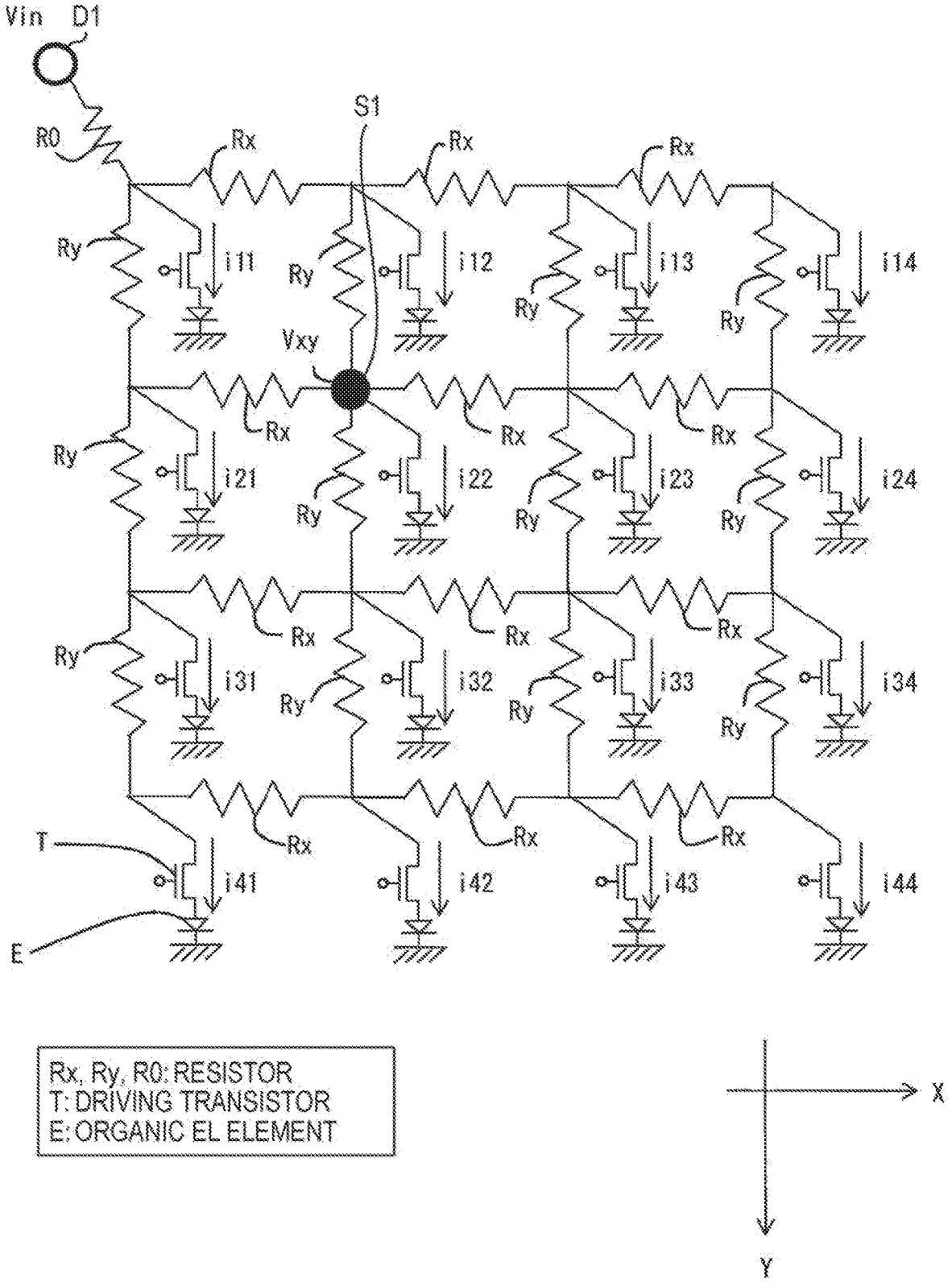
FIG. 3 is an example of an equivalent circuit illustrating the configuration of power supply wiring in the display unit.

The inside of the display unit 10 can be modeled as an equivalent circuit illustrated in FIG. 3. FIG. 3 is an example of an equivalent circuit illustrating the configuration of power supply wiring in the display unit 10. The input terminal of a power supply (not illustrated) is connected to a terminal D1. The power supply applies an input voltage Vin to the display unit 10, and currents ill to i44 flow to driving transistors T, respectively. The location of the connection (terminal D1) in the wiring in the display unit 10 with the input terminal of the power supply for the display unit 10 may be a different location from that illustrated in FIG. 3. In addition, a plurality of input terminals of the power supply may be connected to the wiring in the display unit 10. A resistor R0 is a wiring resistor, resistors Rx are wiring resistors in an X direction, and resistors Ry are wiring resistors in a Y direction. The X direction and the Y direction are orthogonal to each other. A driving transistor T and an organic EL element E are connected to a part S1 where a wiring line extending in the X direction and a wiring line extending in the Y direction intersect wish each other. The driving transistor T drives the organic EL element E, and the organic EL element E thereby emits light. Each of the sub pixels 115, 120, and 125 corresponds to one organic EL element. That is, one sub pixel corresponds to one organic EL element E. The organic EL element E is an organic light emitting diode (OLED).

(Harmful Influence of IR Drop on Displaying)

A harmful influence of an IR drop on displaying will be described based on FIGS. 4(*a*) and 4(*b*). Coordinates are herein used to express each pixel on the display surface 105. A rightward direction is the X direction in FIG. 4, and a downward direction is the Y direction in FIG. 4. Since the 25×25 pixels 110 are provided on the display surface 105, the X coordinate has X0 to X24, and the Y coordinate has Y0 to Y24.

The cause of IR drop occurrence is that displaying a certain region leads to high current flow to organic EL elements E in the region, and thereby a voltage drop occurs in a different region. The magnitude of the IR drop event is attributable to the panel structure of the display unit 10. Hence, it is necessary to know information regarding how much displaying a region of the used panel influences a different region. Hereinafter, the IR drop will be described specifically.

Figure 4:
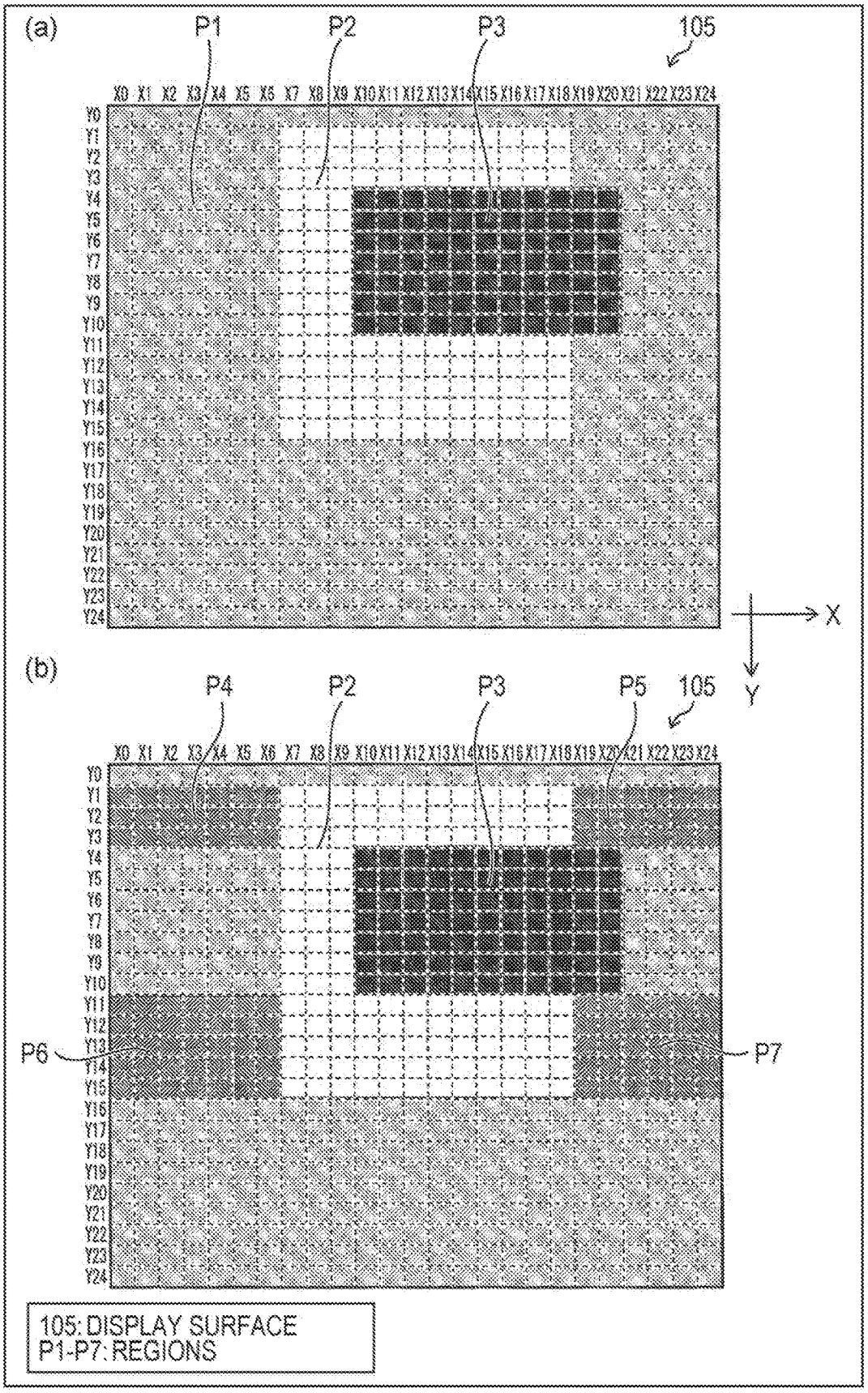
FIG. 4(*a*) is a view illustrating image data for display on the display surface of the display unit, and FIG. 4(*b*) is a view illustrating an image displayed on the display surface of the display unit based on the image data in FIG. 4(*a*).

FIG. 4(*a*) is a view illustrating image data for display on the display surface 105 of the display unit 10. The image data for the display on the display surface 105 is image data for displaying a bright image (high brightness image) in a region P2 and for displaying a dark image in a region P3. A region P1 is a part except the region P2 and the region P3 on the display surface 105. The region P2 corresponds to a part on the display surface 105 except the part where the region P2 and the region P3 overlap from the part corresponding to X7 to X18 and Y1 to Y15. The region P3 is a part corresponding to X10 to X20 and Y4 to Y10 on the display surface 105.

FIG. 4(*b*) is a view illustrating an image displayed on the display surface 105 of the display unit 10 based on the image data in FIG. 4(*a*). Regarding the region P2 and the region P3, the image displayed on the display surface 105 is the same as that in the case of FIG. 4(*a*). However, regarding the region P1, brightness is changed in a region P4, a region P5, a region P6, and a region P7. The regions P4, P5, P6, and P7 are darker than in the case of FIG. 4(*a*). The region P4 is a part corresponding to X0 to X6 and Y1 to Y3 on the display surface 105. The region P5 is a part corresponding to X19 to X24 and Y1 to Y3 on the display surface 105. The region P6 is a part corresponding to X0 to X6 and Y11 to Y15 on the display surface 105. The region P7 is a part corresponding to X19 to X24 and Y11 to Y15 on the display surface 105.

In a case where an image is displayed on the display surface 105 based on the image data in FIG. 4(*a*), higher current than that in the other regions flows to the organic EL elements E in the region P2 (a high brightness region) on the display surface 105. The flowing of the current through the wiring resistor leads to the lowering of the voltages of the organic EL elements E adjacent to the region P2. As illustrated in FIG. 4(*b*), the regions P4, P5, P6, and P7 adjacent to the region P2 become darker (the brightness is lowered).

The darkening event as in the regions P4, P5, P6, and P7 is attributable to the wiring topology or wiring resistance, and a darker place or the degree of brightness lowering varies depending on the wiring topology or the wiring resistance. FIG. 4(*b*) illustrates an example of a case where current flowing to the organic EL elements E in the region P2 highly influences the organic EL elements E in the X direction.

In this case, for example, the high brightness region (region P2) adjacent to the part corresponding to X0 to X6 and Y1 to Y3 extends farther in the X direction than the part corresponding to X0 to X6 and Y4 to Y10. Accordingly, current flowing to each organic EL element E in the part corresponding to X0 to X6 and Y1 to Y3 is higher than current flowing to each organic EL element E in the part corresponding to X0 to X6 and Y4 to Y10. That is, a voltage drop (IR drop) in each organic EL element E in the part corresponding to X0 to X6 and Y1 to Y3 is larger than a voltage drop in each organic EL element E in the part corresponding to X0 to X6 and Y4 to Y10. Accordingly, although the brightness of the region P1 is the same over the region in the image data illustrated in FIG. 4(*a*), the part corresponding to X0 to X6 and Y1 to Y3 is darker than the part corresponding to X0 to X6 and Y4 to Y10 in the image illustrated in FIG. 4(*b*). The part corresponding to X0 to X6 and Y1 to Y3 is influenced by the region P1 more than the part corresponding to X0 to X6 and Y4 to Y10 is.

A border line appears between the part corresponding to X0 to X6 and Y1 to Y3 and the part corresponding to X0 to X6 and Y4 to Y10, and the image quality of the image is deteriorated. The IR drop has influence on the brightness of the regions adjacent to the high brightness region; however, generally, the influence is not high so much. Accordingly, in a case where the display image is changed largely between frames, an image brightness change caused by an IR drop is not notable due to a change in the display image despite the occurrence of the IR drop.

A case where the change caused by the IR drop is notable is a case where the high brightness region is changed slightly between frames. That is, in a case where an IR drop occurs in an image similar to a still image, a change caused by the IR drop is notable. In the present invention, in a state where consecutive images do not change largely, a correction value is calculated by using image data, and correction is applied to image data regarding the next frame. If the image data changes slightly between the consecutive frames, the correction value is applied to the image data regarding the next frame. Details will be described later.

(Base Parameter Calculation)

Figure 5:
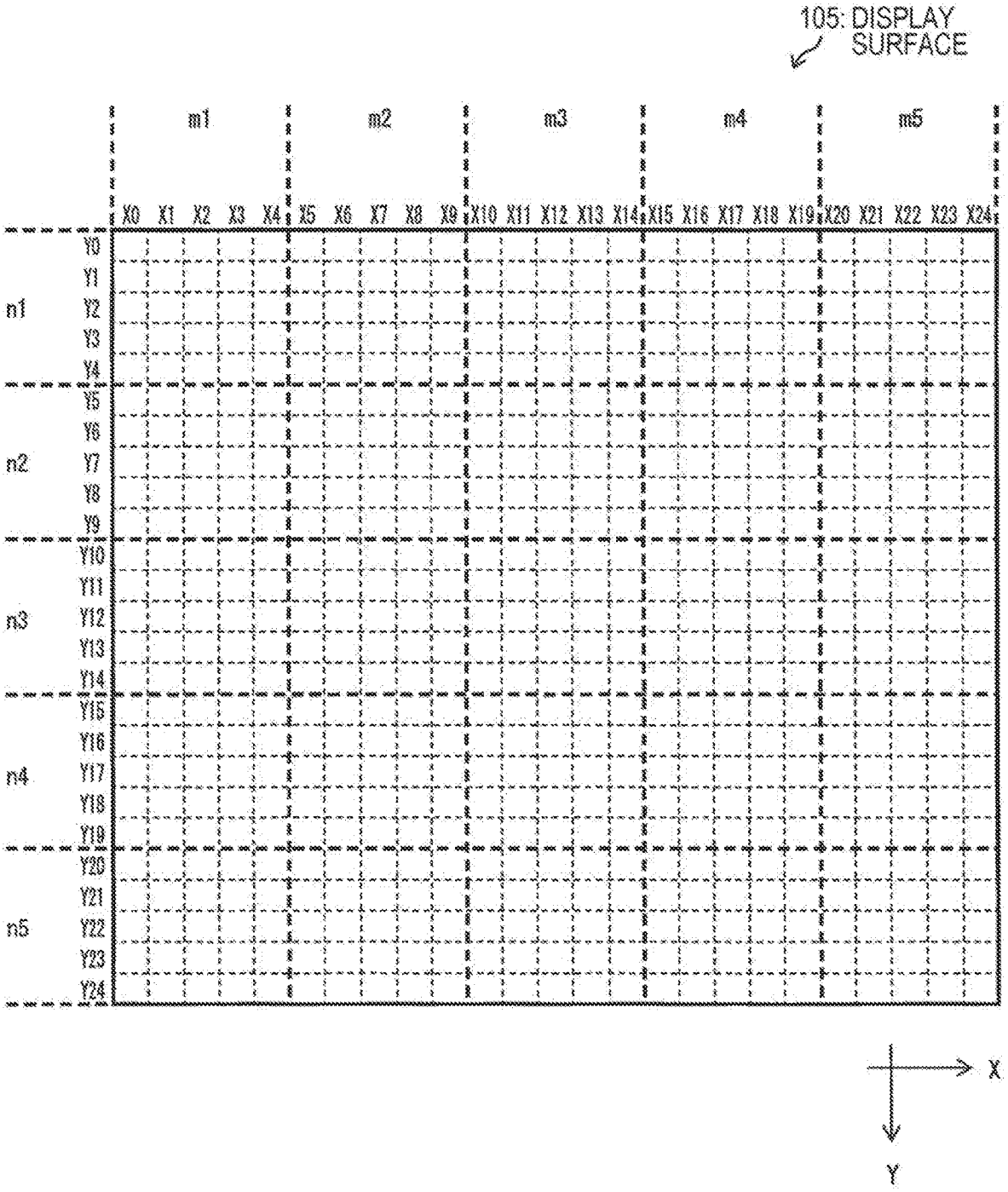
FIG. 5 is a view illustrating a state where the display surface of the display unit is divided into a plurality of uniform regions.

Base parameter calculation will be described based on FIGS. 5 and 6. As illustrated in FIG. 5, the display surface 105 is divided into 5×5 uniform regions. FIG. 5 is a view illustrating a state where the display surface 105 of the display unit 10 is divided into a plurality of uniform regions. The case of the division into the 5×5 regions is herein described; however, the configuration is not limited to the configuration in which the display surface 105 is divided into the 5×5 uniform regions. For example, the display surface 105 may be divided into 10×10 uniform regions and may also be divided into further more uniform regions.

As the display surface 105 is divided into more regions, degrees of voltage-drop-influence AD (described later) can be calculated with more levels. The accuracy of the degrees of voltage-drop-influence AD is thus enhanced. However, dividing the display surface 105 into a large number of regions leads to an enormous circuit scale and a huge amount of calculation runtime to calculate the degrees of voltage-drop-influence AD. Hence, it is necessary to decide a small number of divisions to prevent the accuracy of the degrees of voltage-drop-influence AD from lowering excessively.

A characteristic extraction apparatus 2 illustrated in FIG. 1 calculates base parameters. The characteristic extraction apparatus 2 includes a region uniform-division unit 40 and a base-parameter calculation unit 50 and is an apparatus for extracting and modeling the characteristics of the display unit 10 when the model of the image display apparatus 1 is decided.

The region uniform-division unit 40 divides the display surface 105 into the 5×5 uniform regions. In FIG. 5, coordinates are used to express the 5×5 regions by using m1 to m5 in the X direction and n1 to n5 in the Y direction. For example, a region corresponding to m1 and n1 is expressed as a region (m1, n1). Each region uniformly divided by the region uniform-division unit 40 includes 5×5 pixels.

The base-parameter calculation unit 50 calculates the base parameters. The base parameters respectively represents degrees of influence BP (second degrees of influence) that are each the degree of influence of a corresponding one of the 5×5 regions on a different region. The base-parameter calculation unit 50 calculates each base parameter by measuring a brightness change between one of the regions and a different one of the regions. Specifically, a brightness change in the different region relative to a brightness change in the one region is measured. The base-parameter calculation unit 50 calculates the degrees of influence BP of the influence of a region on the other regions adjacent to the region for all of the regions. The influence of not only the location of the connection in the wiring in the display unit 10 with the input terminal of the power supply for the display unit 10 but also the wiring configuration of the display unit 10 is reflected on each degree of influence BP.

If information such as a wiring topology or wiring resistance is used, steps for calculating the degree of influence BP can generally be simplified. For example, in a case where wiring lines are connected only in the Y direction or where wiring resistors (resistors Rx) in the X direction have an extremely large resistance, the degree of influence BP can be calculated based on only the resistance of the wiring resistor (resistor Ry) in the Y direction. In addition, in the above case, if the degree of influence BP in the region corresponding to the Y24 row is measured, the degree of influence BP of a region in the middle location (region corresponding to the Y12 row) can be calculated based on the resistance of the resistor Ry.

Further, generally, if the information such as a wiring topology or wiring resistance is known, a relative value that is the degree of influence BP attributed to a location in the display unit 10 can be determined by modeling the wiring configuration of the display unit 10 such as by mesh modeling and then performing simulation. The modeling of the wiring configuration of the display unit 10 is not limited to the mesh modeling. The base-parameter calculation unit 50 models the wiring configuration of the display unit 10 as the equivalent circuit as illustrated in FIG. 3 and infers virtual resistive elements (resistors Rx and Ry) and the like in the equivalent circuit to match the actual measurement result. The actual measurement result is the result of brightness measurement performed by the brightness calculation unit 210. The base-parameter calculation unit 50 applies the inferred resistive elements to the equivalent circuit, performs simulation based on the equivalent circuit, and thereby determines the relative value as the degree of influence BP attributed to the location in the display unit 10. Based on the relative value as the degree of influence BP, from the calculation result of the degrees of influence BP of several locations, the degrees of influence BP of different locations can be calculated. In addition, the frequency of a voltage drop is obtained as a simulation result. From the simulation result and the voltage-brightness characteristics of the light emitting elements, the degrees of influence BP on the brightness can be obtained. The base-parameter calculation unit 50 performs such simulation by using various typical display patterns and thereby adjusts each degree of influence BP to obtain an appropriate degree of influence BP. As a typical display pattern, image data simplified to facilitate calculation of the degree of influence BP of one region on a different region in the simulation is used. For example, generally, the brightness of only one region of uniformly divided regions may be fixed to 255, and the brightness of regions other than the one region may be set to 128.

Hereinafter, the base parameter calculation will be described. For example, the base-parameter calculation unit 50 selects a region (m1, n1) and a region (m2, n1) and changes the brightness level of the region (m1, n1), with the brightness level of the region (m2, n1) being fixed. The base-parameter calculation unit 50 measures a change in the brightness level of the region (m2, n1) when the brightness level of the region (m1, n1) is changed. As illustrated in FIG. 6, for example, in a case where the brightness level of the region (m1, n1) is 255, the degree of influence BP of the region (m2, n1) is 127. FIG. 6 is a view illustrating the degree of influence BP of each of the uniform regions on the display surface 105 of the display unit 10. The brightness level of the region (m1, n1) is a brightness level total of the pixels in the region (m1, n1). The degree of influence BP of the region (m2, n1) represents the degree of influence of the brightness level of the region (m2, n1) on the brightness level of the region (m1, n1).

The degree of influence BP of the region (m2, n1) relative to the brightness level of the region (m1, n1) is expressed as BP(m1, n1, m2, n1). When the region (m1, n1) is selected in the case of division into 5×5 regions, the base-parameter calculation unit 50 calculates the degrees of influence BP for 25 regions (m, n) from the region (m1, n1) to the region (m5, n5). Accordingly, the number of the degrees of influence BP(m1, n1, m, n) influencing the region (m1, n1) on the region itself and the other regions is 25.

FIG. 6 assumes a case where the degrees of influence BP of the region (m1, n1) on the region itself and a different region are in inverse proportion to Manhattan distance between the region (m1, n1) and the different region. Since the base-parameter calculation unit 50 likewise calculates the degrees of influence BP of the region itself and regions different from the region (m1, n1) for each different region, the number of calculated degrees of influence BP is 25×25=625. For example, in the case of selecting the region (m2, n1), the base-parameter calculation unit 50 calculates the degrees of influence BP for the 25 regions (m, n) from the region (m1, n1) to the region (m5, n5).

The base-parameter calculation unit 50 stores the degrees of influence BP calculated for the 25 regions (m, n) from the region (m1, n1) to the region (m5, n5) in the base parameter memory unit 240 in the brightness correction device 20 in the image display apparatus 1. The base parameter memory unit 240 stores therein the degrees of influence BP supplied from the base-parameter calculation unit 50.

As described above, the base-parameter calculation unit 50 calculates each degree of influence BP influencing one region on the region itself and a different region. In addition, the influence of not only the location of the connection in the wiring in the display unit 10 with the input terminal of the power supply for the display unit 10 but also the wiring configuration of the display unit 10 is reflected on each degree of influence BP. This enables a case where the place where the power supply for the display unit 10 is connected in the display unit 10 and the wiring configuration of the display unit 10 are changed to be taken into consideration.

Note that if information such as a wiring topology or wiring resistance is known, inferred resistive elements can be applied to a modeled equivalent circuit, and thus the processing for calculating the degrees of influence BP by the base-parameter calculation unit 50 can be simplified.

Note that the regions divided by the characteristic extraction apparatus 2 do not have to be uniform. Hereinafter, a case of ununiform regions divided by the characteristic extraction apparatus 2 will be described. In this case, the characteristic extraction apparatus 2 includes a second region-division unit instead of the region uniform-division unit 40. The second region-division unit divides the display surface 105 into a plurality of regions such that a region in a place, in the display surface 105, having a slight change in the degree of voltage-drop-influence from a spatial viewpoint has a large area. The second region-division unit also divides the display surface 105 into the plurality of regions such that a region in a place, in the display surface 105, having a considerable change in the degree of voltage-drop-influence from a spatial viewpoint has a small area.

(Calculation of Brightness Level Total and Differences)

The calculation of brightness level total and differences will be described based on FIG. 7. The brightness calculation unit 210 calculates brightness levels PL for the respective 25×25 pixels 110. A specific description is provided below. The brightness calculation unit 210 refers to the input image data supplied by the image-data acquisition unit 60 and the brightness control information LL supplied by the brightness adjustment unit 30. The input image data includes data regarding the gradations of the sub pixels 115, 120, and 125 included in each pixel 110. The data regarding the gradations of the sub pixels 115, 120, and 125 is data regarding red, green, and blue gradations. The brightness calculation unit 210 calculates the brightness levels PL of the pixels 110 from the data regarding the red, green, and blue gradations. The result of calculation of the brightness levels PL of the pixels 110 is a result as illustrated in FIG. 7. The use of Formula (1) below to calculate the brightness levels of the pixels 110 from the red, green, and blue gradations is known.

$$PL=\alpha\times R+\beta\times G+\gamma\times B \quad (1)$$

PL denotes a brightness level, R denotes red gradation, G denotes green gradation, and B denotes blue gradation. In addition, $\alpha=0.299$, $\beta=0.587$, and $\gamma=0.114$ are provided, and $\alpha$, $\beta$, and $\gamma$ values conform to the ITU-R BT.601 standard.

However, even if pixels have the same brightness level, and if the brightness adjustment unit 30 adjusts the brightness level in image data depending on the brightness of the surroundings of the image display apparatus 1, voltage drop values vary. To calculate the brightness levels of the pixels 110 in consideration of processing by the brightness adjustment unit 30, Formula (2) below is used with the brightness control information LL.

$$PL=LL\times(\alpha\times R+\beta\times G+\gamma\times B) \quad (2)$$

The brightness control information LL is a value indicating how high the brightness level decided by the brightness adjustment unit 30 is. The brightness calculation unit 210 supplies the calculated brightness levels PL of the pixels 110 to the correction determination unit 215, the region division unit 220, and the regional brightness-level-total calculation unit 225 simultaneously.

The region division unit 220 includes a brightness-level-total calculation unit 220*a*, a difference calculation unit 220*b*, and a border selection unit 220*c* and divides the display surface 105 into a plurality of regions.

Based on the brightness levels of the pixels 110 calculated by the brightness calculation unit 210, the brightness-level-total calculation unit 220*a* totals the brightness levels PL of the pixels 110 for each line of the pixels 110. A specific description is provided below. The brightness-level-total calculation unit 220*a* totals the brightness levels PL of the pixels 110 for each of the columns from X0 to X24. The brightness-level-total calculation unit 220*a* also totals the brightness levels PL of the pixels 110 for each of the rows from Y0 to Y24. For example, the brightness-level-total calculation unit 220*a* totals the brightness levels PL of the pixels 110 included in the X0 column. As illustrated in FIG. 7, the brightness levels PL of the pixels 110 included in the X0 column totals 3200. The brightness-level-total calculation unit 220*a* supplies the calculated totals of the brightness levels PL to the difference calculation unit 220*b*. Note that the totals of the brightness levels PL of the pixels 110 on a per line basis are illustrated on the right part and lower part of FIG. 7.

The difference calculation unit 220*b* refers to each total of the brightness levels PL of the pixels 110 calculated by the brightness-level-total calculation unit 220*a* for the corresponding line of the pixels 110. The difference calculation unit 220*b* calculates a difference in the total of the brightness levels PL between mutually adjacent lines including the pixels 110. A specific description is provided below. The difference calculation unit 220*b* calculates a difference in the total of the brightness levels PL between mutually adjacent columns of the columns from X0 to X24. The difference calculation unit 220*b* also calculates a difference in the total of the brightness levels PL between mutually adjacent rows of the rows from Y0 to Y24. Note that each of these differences is an absolute value. For example, the difference calculation unit 220*b* calculates a difference in the total of the brightness levels PL between the X0 column and the X1 column adjacent to each other. As illustrated in FIG. 7, the difference in the total of the brightness levels PL between the X0 column and the X1 column adjacent to each other is zero. The difference calculation unit 220*b* supplies each calculated difference in the total of the brightness levels PL between the mutually adjacent lines including the pixels 110 to the border selection unit 220*c*. Note that each difference in the total of the brightness levels PL between the mutually adjacent lines including the pixels 110 is illustrated in the right part and lower part of FIG. 7.

The border selection unit 220*c* refers to the difference in the total of the brightness levels PL between the mutually adjacent lines including the pixels 110 calculated by the difference calculation unit 220*b*. Based on the difference in the total of the brightness levels PL between the mutually adjacent lines including the pixels 110, the border selection unit 220*c* divides the display surface 105 into a plurality of regions (the 5×5 regions herein).

In a case where the display surface 105 is divided into the 5×5 regions, the border selection unit 220*c* selects a difference the number of which is not more than four (a predetermined number of differences) from the highest among the differences calculated by the difference calculation unit 220*b*. For example, as illustrated in FIG. 7, the border selection unit 220*c* selects differences the number of which is not more than four from the highest in the X direction. Specifically, the border selection unit 220*c* selects a difference of 1905, a difference of 1561, a difference of 1016, and a difference of 672. The difference of 1905 is a difference in the total of the brightness levels PL between the X6 column and the X7 column, and the difference of 1561 is a difference in the total of the brightness levels PL between the X9 column and the X10 column. The difference of 1016 is a difference in the total of the brightness levels PL between the X18 column and the X19 column, and the difference of 672 is a difference in the total of the brightness levels PL between the X20 column and the X21 column.

Note that the border selection unit 220*c* may select a difference that is more than or equal to a first threshold and the number of which is not more than four from the highest among the differences calculated by the difference calculation unit 220*b*. This can eliminate small fluctuation in the image caused by processing by the brightness correction unit 235 and prevent a border line from appearing in the image. Examples of the cause of the fluctuation include input noise, dithering processing, PenTile SPR (Sub Pixel Rendering) processing, and the like.

The border selection unit 220*c* also selects a difference the number of which is not more than four in the Y direction from the highest. Specifically, the border selection unit 220*c* selects a difference of 1524, a difference of 2199, a difference of 2199, and a difference of 1524. One of the differences of 1524 is a difference in the total of the brightness levels PL between the Y0 row and the Y1 row, and one of the differences of 2199 is a difference in the total of the brightness levels PL between Y3 row and the Y4 row. The other difference of 2199 is a difference in the total of the brightness levels PL between Y10 row and the Y11 row, and the other difference of 1524 is a difference in the total of the brightness levels PL between Y15 row and the Y16 row.

Figure 8:
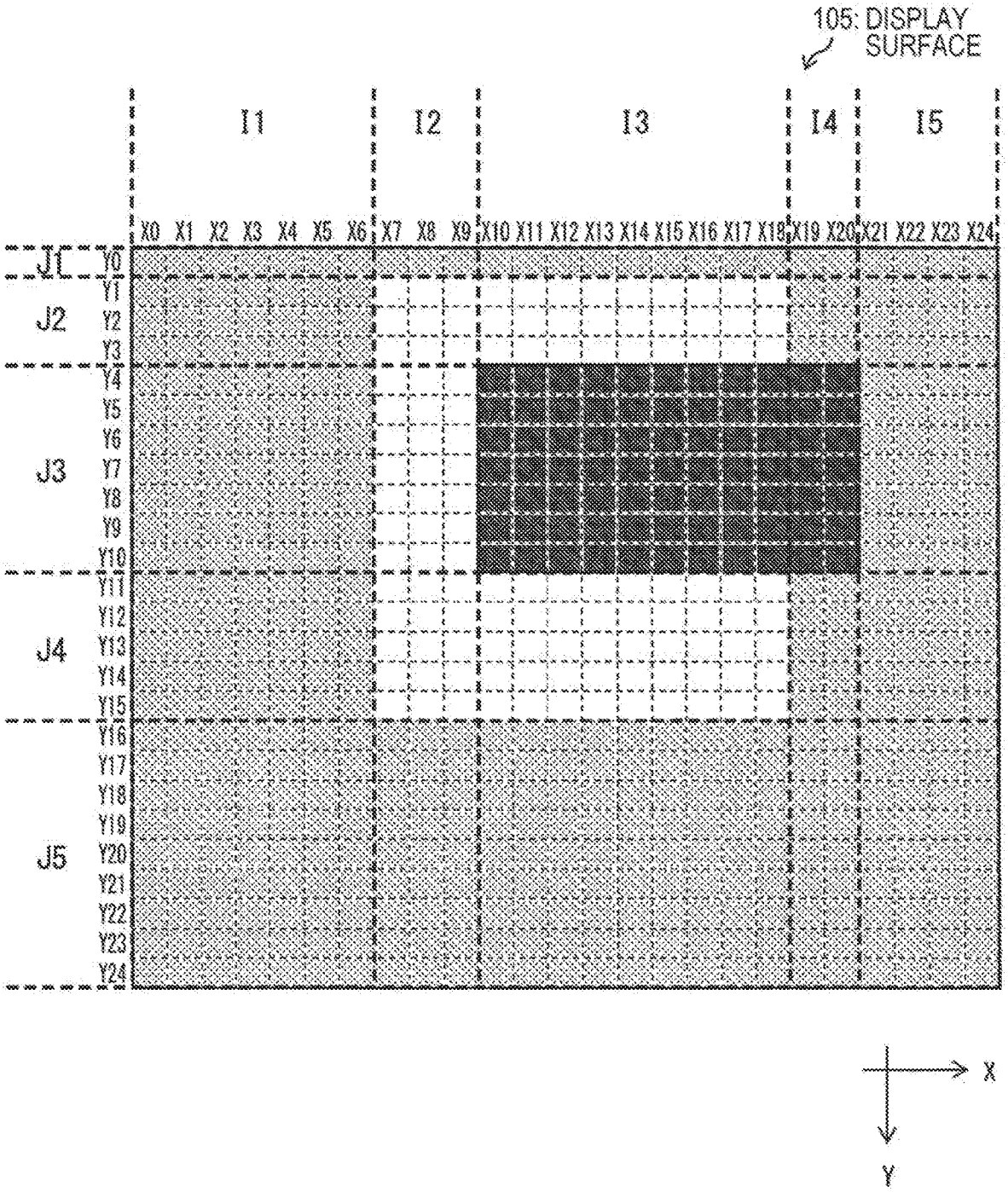
FIG. 8 is a view illustrating a state where the display surface of the display unit is divided into a plurality of regions.

The border selection unit 220*c* selects a border between the lines of the pixels 110 corresponding to the selected difference and sets the border to a border for division. The regions resulting from the division are, for example, 5×5 regions as illustrated in FIG. 8. Since the border selection unit 220*c* selects the differences the number of which is not more than four in the X direction and the differences the number of which is not more than four in the Y direction, the number of pieces of data regarding information representing the regions resulting from the division is 8. The border selection unit 220*c* supplies region division information AX and region division information AY to a correction-target-frame determination unit 215*a* and the regional brightness-level-total calculation unit 225. The region division information AX is information indicating that region division is performed in the X direction, and the region division information AY is information indicating that region division is performed in the Y direction.

Note that the regions resulting from the division by the border selection unit 220*c* and the regions resulting from the division by the region uniform-division unit 40 do not have to match. The larger the number of regions resulting from the division by the border selection unit 220*c* or regions resulting from the division by the region uniform-division unit 40 is, the more correctly image data can be corrected. However, a computation amount is increased. Accordingly, the size of a processing circuit used for the computation is increased, and cost is increased.

The 5×5 regions divided by the border selection unit 220*c* are expressed by using coordinates of I1 to I5 in the X direction and J1 to J5 in the Y direction. For example, a region corresponding to I1 and J1 is expressed as a region (I1, J1). Each region resulting from the division by the border selection unit 220*c* includes a plurality of pixels.

Setting a border between the lines of the pixels 110 corresponding to a difference selected by the border selection unit 220*c* leads to relatively uniform brightness levels of the pixels in each region. In addition, since a region having relatively uniform brightness-level pixels can be extracted, correction common to the pixels in the region can be applied on a per region basis. Accordingly, variation in the brightness levels of the pixels can be suppressed in the region including relatively uniform brightness-level pixels.

(Correction Target Frame Determination)

Correction target frame determination will be described. In an image having a considerable change between frames like a moving image, trouble such as the occurrence of a border due to an IR drop is not notable. Accordingly, an image having a slight change between consecutive frames like a still image is decided as a correction target. The correction target frame determination is performed by the correction-target-frame determination unit 215*a* in the correction determination unit 215. Processing by the correction determination unit 215 can be performed concurrently with processing by the regional brightness-level-total calculation unit 225, the degree-of-influence calculation unit 230, and the brightness correction unit 235. In addition, the reason why the processing is performed by the correction determination unit 215 will be described below.

When an image with one frame is corrected, processing performed by the region division unit 220, the regional brightness-level-total calculation unit 225, and the brightness correction unit 235 requires data regarding the brightness levels PL of the entire pixels 110. In the present invention, the brightness calculation unit 210 supplies the calculated brightness levels PL of the pixels 110 to the correction determination unit 215, the region division unit 220, and the regional brightness-level-total calculation unit 225 simultaneously. Accordingly, when the image with one frame is corrected, it suffices that the brightness correction device 20 scans data regarding the brightness levels PL of the entire pixels 110 only one time. Accordingly, the brightness correction device 20 does not scan the frame several times, and thus an extra delay does not occur. In addition, the processing speed does not have to be made excessively high.

In addition, the correction determination unit 215 determines frames having a slight image change therebetween among consecutive frames and sets one of the consecutive frames as a correction target frame. That is, data regarding the brightness levels PL of the entire pixels 110 in the same frame is used in the processing performed by the region division unit 220, the regional brightness-level-total calculation unit 225, and the brightness correction unit 235. Accordingly, the processing can be performed without storing the data regarding the brightness levels PL of the entire pixels 110 in the memory. Only in a state where the processing does not fail, image correction is performed.

However, to appropriately perform the processing by the correction determination unit 215, it is necessary to determine whether data regarding the brightness levels PL of pixels in a certain frame is identical to data regarding the brightness levels PL of pixels in a frame succeeding the certain frame, the pixels being located in the same positions as those of the pixels in the certain frame. Accordingly, the data regarding the brightness levels PL of the entire pixels 110 needs to be stored in the memory. Hence, in the present invention, processing to be described below is performed, and thereby the processing is performed without storing the data regarding the brightness levels PL of the pixels in one frame in the memory.

For each frame, the correction-target-frame determination unit 215*a* determines whether the frame is a correction target frame by checking an image change between frames and then determining whether the image is a still image. When it is determined as to whether the image is a still image, typically, a piece of image data regarding a preceding frame among pieces of data regarding the respective consecutive frames is stored in the memory. In the pieces of data regarding the respective consecutive frames, a gradation difference between pixels corresponding to each other is calculated. The calculating of the gradation difference enables to determine whether the image data represents a still image correctly.

In contrast, the correction-target-frame determination unit 215*a* determines whether Condition 1 and Condition 2 below are satisfied by using the brightness levels PL of the pixels 110 calculated by the brightness calculation unit 210 and the information (region division information AX and AY) acquired by the border selection unit 220*c*. The correction-target-frame determination unit 215*a* determines the most recent frame satisfying Condition 1 and Condition 2 below as a still image. This enables to determine whether the image data is a still image without storing, in the memory, a piece of image data regarding the preceding frame among the pieces of data regarding the respective consecutive frames.

(1) Condition 1 is a condition described below. Among pieces of image data regarding the respective consecutive frames, regions divided in the most recent frame by the border selection unit 220*c* and regions divided in the frame one frame before the most recent frame by the border selection unit 220*c* match. Alternatively, among the pieces of image data regarding the respective consecutive frames, the maximum value of a difference between the location of the border between regions divided in the most recent frame by the border selection unit 220*c* and the location of the border between regions divided in the frame one frame before the most recent frame by the border selection unit 220*c* is less than a second threshold.

(2) Condition 2 is a condition described below. Among the pieces of image data regarding the respective consecutive frames, a difference between the maximum value of differences calculated for the most recent frame by the difference calculation unit 220*b* and the maximum value of differences calculated for the frame one frame before the most recent frame by the difference calculation unit 220*b* is less than a third threshold.

In this case, if in the consecutive frames, pieces of image data from a piece of image data regarding the frame three frames before the most recent frame to a piece of image data regarding the most recent frame are determined consecutively as a still image, the piece of image data regarding the most recent frame is determined as a correction target frame (target frame). The frames from the piece of image data regarding the frame three frames before the most recent frame to the piece of image data regarding the frame one frame before the most recent frame are not determined as the correction target frame. This enables a harmful effect due to the correction to be minimized because the correction is performed only in a case where the influence of the IR drop is notable.

The correction-target-frame determination unit 215*a* supplies information regarding the determined frame to a correction-applicable-pixel decision unit 215*b* and instructs the correction-applicable-pixel decision unit 215*b* to perform processing.

(Correction-Applicable-Pixel Decision)

Correction-applicable-pixel decision will be described. The correction-applicable-pixel decision is performed by the correction-applicable-pixel decision unit 215*b* in the correction determination unit 215. If a brightness level PL of a pixel 110 has a value close to a median, or if there is a slight difference between the brightness level PL of a certain pixel 110 and the brightness level PL of an adjacent pixel 110, the influence of the voltage drop is likely to be notable. Accordingly, the correction-applicable-pixel decision unit 215*b* determines whether Condition 3 and Condition 4 below are satisfied. If Condition 3 and Condition 4 below are satisfied, the correction-applicable-pixel decision unit 215*b* determines the pixel 110 as a correction-applicable pixel.

(1) Condition 3 is a condition described below. Regarding predetermined thresholds Pmax and Pmin, the brightness level PL(x) of a target pixel x satisfies Formula (3) below.

$$Pmin \leq PL(x) \leq Pmax \tag{3}$$

(2) Condition 4 is a condition described below.

Regarding a predetermined threshold STH, the brightness level PL(x) of the target pixel x and brightness levels PL(x−1) and PL(x+1) of the pixel (x−1) adjacent to the target pixel x and the pixel (x+1), respectively, satisfy Formula (4) and Formula (5) below.

$$ABS(PL(x-1)-PL(x)) \leq STH \tag{4}$$

$$ABS(PL(x+1)-PL(x)) \leq STH \tag{5}$$

ABS is a function of returning an absolute value of an argument.

The correction-applicable-pixel decision unit 215*b* supplies information regarding the pixel 110 determined as a correction-applicable pixel (correction determination information) to the brightness correction unit 235.

(Regional Brightness-Level-Total Calculation)

The regional brightness-level-total calculation unit 225 refers to the brightness levels PL of the pixels 110 calculated by the brightness calculation unit 210 and the information (region division information AX and AY) indicating regions resulting from the division by the border selection unit 220*c*. Based on the information indicating the regions resulting from the division by the border selection unit 220*c*, the regional brightness-level-total calculation unit 225 calculates a regional brightness-level total AL that is the total of the brightness levels PL of the pixels 110 in each region resulting from the division by the border selection unit 220*c*. In a case where the regional brightness-level total AL is calculated for each of the 5×5 regions, the number of pieces of data regarding the regional brightness-level total AL is 25.

Figure 9:
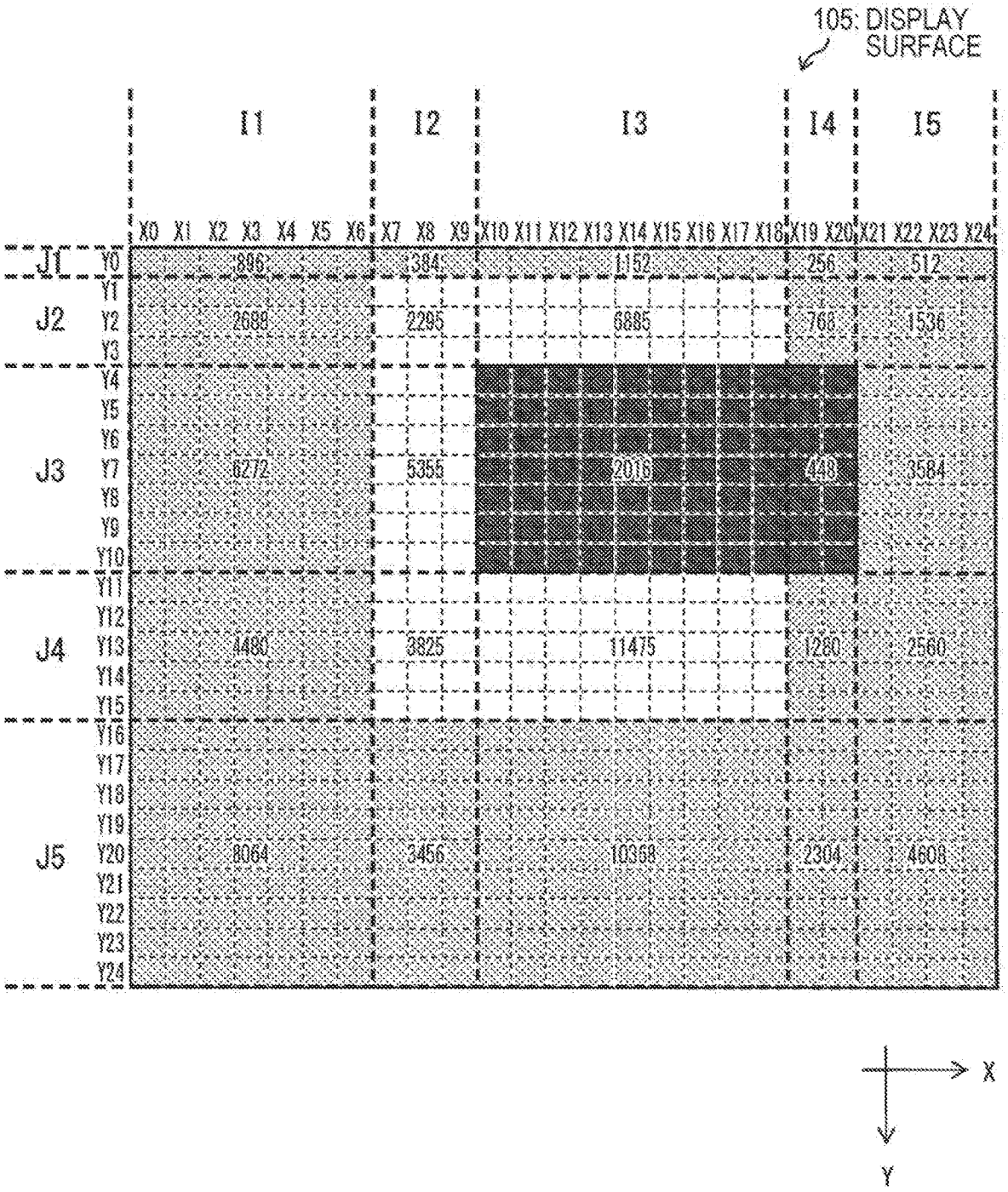
FIG. 9 is a view illustrating the total of brightness levels in each region of the display surface of the display unit.

The result of the calculation of the regional brightness-level total AL for each region resulting from the division by the border selection unit 220*c* is the result as illustrated in FIG. 9. FIG. 9 is a view illustrating the total of the brightness levels PL for each of the plurality of regions on the display surface 105 of the display unit 10. As illustrated in FIG. 7, since the region (I1, J1) is composed of the seven pixels 110 each having the brightness level PL of the pixel that is 128, the calculation of the regional brightness-level total AL (I1, J1) of the region (I1, J1) results in AL(I1, J1)=128×7=896 and likewise AL(I3, J4)=255×(9×5)=11475.

A large region resulting from the division tends to have a high regional brightness-level total AL, and a large panel size tends to have a high regional brightness-level total AL. The regional brightness-level total AL may have been normalized not to be attributable to the panel size. A specific description is provided below. The base parameters are calculated based on the 25 regions resulting from the division by the region uniform-division unit 40. Normalization may be performed to have the maximum value of 1.0 of the regional brightness-level total AL. That is, the normalization is performed to cause the logical maximum value of the regional brightness-level total AL to have a constant value. The maximum value of the regional brightness-level total AL is not particularly a specific value and does not have to be 1.0.

The regional brightness-level-total calculation unit 225 supplies the calculated regional brightness-level total AL to the degree-of-influence calculation unit 230.

(Calculation of Degree of Voltage-Drop-Influence)

The calculation of the degree of voltage-drop-influence AD will be described based on FIG. 10.

The regions resulting from the division by the border selection unit 220*c* do not necessarily have the uniform size. For example, the regions resulting from the division by the region uniform-division unit 40 illustrated in FIG. 10(*a*) are different from the regions resulting from the division by the border selection unit 220*c* illustrated in FIG. 10(*b*).

Figure 10:
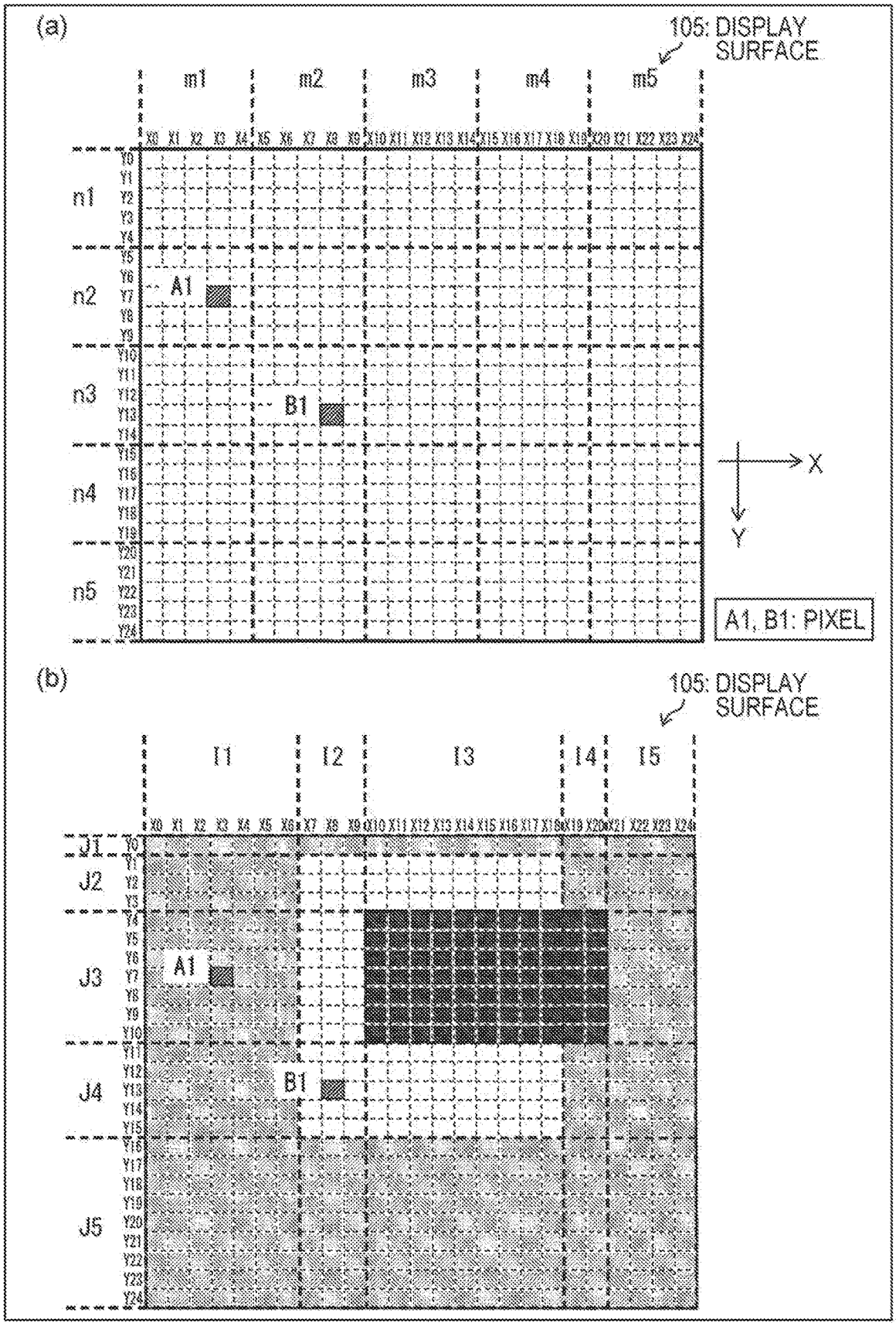
FIG. 10(*a*) is a view illustrating the state where the display surface of the display unit is divided into a plurality of uniform regions, and FIG. 10(*b*) is a view illustrating a state where the display surface of the display unit is divided into a plurality of regions.

On the display surface 105, the location of the region (I2, J4) illustrated in FIG. 10(*b*) is close to the location of the region (m2, n3) illustrated in FIG. 10(*a*). The degree of influence of the brightness level PL of a region on a different region is attributable to a location relationship between the regions. Here, it is assumed that the pixel 110 in the center of a region is influenced. For example, the degree of influence BP (m1, n2, m2, n3) indicating the influence of the region (m1, n2) on the region (m2, n3) is used as the degree of influence BP indicating the influence of the region (I1, J3) on the region (I2, J4). A specific description is provided below.

For each of the 5×5 regions, the degree-of-influence calculation unit 230 calculates the degree of voltage-drop-influence AD (first degree of influence) based on the degree of influence BP and the regional brightness-level total AL, the degree of voltage-drop-influence AD representing the degree of influence of the brightness level PL of each region resulting from the division by the border selection unit 220*c* on a corresponding one of the brightness levels PL of respective regions adjacent to the region. A specific description is provided below. Note that in a case where the degree of voltage-drop-influence AD is calculated for each of the 5×5 regions, the number of pieces of data regarding the degree of voltage-drop-influence AD is 25.

The degree-of-influence calculation unit 230 identifies the pixel 110 in the center of each region resulting from the division by the border selection unit 220*c* and identifies which region of the regions resulting from the division by the region uniform-division unit 40 has the pixel 110 in the center. If the pixel 110 corresponding to the center of the region resulting from the division by the border selection unit 220*c* is not present, the degree-of-influence calculation unit 230 selects a pixel 110 in the upper left position, in the left position, or above the center of the region resulting from the division by the border selection unit 220*c*. Note that in the above-described case, the degree-of-influence calculation unit 230 may select a pixel 110 in the upper right position, in the right position, or under the center of the region resulting from the division by the border selection unit 220*c*.

In addition, for example, if a region RA1 resulting from the division by the border selection unit 220*c* corresponds to the X coordinates from X1 to X11, the center coordinate in the X direction in the region RA1 according to calculation is 5.5 (the border between XS and X6). Assume a case where regarding a region PA1 and a region PA2 that are regions resulting from the division by the region uniform-division unit 40, the region PA1 corresponds to the X coordinates from X0 to X5 and the region PA2 corresponds to the X coordinates X6 and higher. In this case, the region RA1 may be present in any of the region PA1 and the region PA2. In addition, if the degree of influence BP of the region PA1 is 10 and the degree of influence BP of the region PA2 is 20, (10+20)/12=15 may be employed as the degree of influence BP used for the degree of voltage-drop-influence AD of the region RA1.

Note that the regions resulting from the division by the border selection unit 220*c* are not necessarily uniform regions. Accordingly, the degree of voltage-drop-influence AD is calculated by the degree-of-influence calculation unit 230 more easily than in a case where the degree of voltage-drop-influence AD is directly calculated from each region resulting from the division by the border selection unit 220*c*. This can reduce a processing amount for calculating the degree of voltage-drop-influence AD. Accordingly, the burden on processing by the image display apparatus 1 can be reduced, and cost can thus be reduced.

In addition, each degree of voltage-drop-influence AD is calculated based on the degree of influence BP on the corresponding region resulting from the division by the region uniform-division unit 40 and including the pixel in the center of the region resulting from the division by the border selection unit 220*c*, and thereby image data regarding the brightness levels PL of the pixels 110 can be corrected appropriately. The degree of voltage-drop-influence AD is calculated based on the degree of influence BP, and thereby the degree of voltage-drop-influence AD represents the relative degree of influence of the brightness level PL of each region resulting from the division by the border selection unit 220*c* on a corresponding one of the brightness levels PL of respective regions adjacent to the region.

Further, not based the gradations of the sub pixels 115, 120, and 125, but based on the brightness level PL of each pixel 110 calculated based on the gradations of the sub pixels 115, 120, and 125, the degree of voltage-drop-influence AD is calculated, and thus the brightness levels PL of the pixels 110 in the image data can be corrected without changing the hue.

Assume that the pixel 110 in the part where the X3 column and the Y7 row intersect is a pixel A1 and the pixel 110 in the part where the X8 column and the Y13 row intersect is a pixel B1. Hereinafter, a case of calculating the degree of influence BP indicating the influence of the region (I1, J3) on the region (I2, J4) will be described.

As illustrated in FIG. 10(*b*), the pixel 110 in the center of the region (I1, J3) is the pixel A1, and the pixel 110 in the center of the region (I2, J4) is the pixel B1. As illustrated in FIG. 10(*a*), the pixel A1 is included in the region (m1, n2), and the pixel B1 is included in the region (m2, n3). Here, the degree of influence BP indicating the influence of the region (m1, n2) on the region (m2, n3) is used as the degree of influence BP indicating the influence of the region (I1, J3) on the region (I2, J4). That is, the region (I1, J3) corresponds to the region (m1, n2), and the region (I2, J4) corresponds to the region (m2, n3).

In addition, the degree of voltage-drop-influence AD is obtained by multiplying the degree of influence BP by the regional brightness-level total AL. Accordingly, in a case where the degree of voltage-drop-influence of the region (I1, J3) on the region (I2, J4) is V(I1, J3, I2, J4), the degree of voltage-drop-influence V(I1, J3, I2, J4) is calculated by the degree-of-influence calculation unit 230 by using Formula (6) below.

$$V(I1,J3,I2,J4)=BP(m1,n2,m2,n3)\times AL(I1,J3) \tag{6}$$

For example, the degree of influence of the region (I2, J2) on the region (I2, J4) due to a voltage drop is likewise calculated by the degree-of-influence calculation unit 230 by using Formula (7) below.

$$V(I2,J2,I2,J4)=BP(m2,n1,m2,n3)\times AL(I2,J2) \tag{7}$$

The pixel in the center of the region (I2, J2) is the pixel in the part where the X8 column and the Y2 row intersect, and the pixel is included in the region (m2, n1). Accordingly, Formula (7) is provided.

The degree of voltage-drop-influence AD (I2, J4) on the region (I2, J4) is the total of the degrees of voltage-drop-influence V of all the regions resulting from the division by the border selection unit 220*c* on the region (I2, J4) and thus is calculated by the degree-of-influence calculation unit 230 by using Formula (8) below.

[Math. 1]

$$AD(I2, J4) = \sum_{\substack{x=1\ to\ 5\\ y=1\ to\ 5}} V(Ix, Iy, I2, J4) \tag{8}$$

Likewise, the degree of voltage-drop-influence AD is calculated for each of the other regions resulting from the division by the border selection unit 220*c*. The degree-of-influence calculation unit 230 supplies the calculated degree of voltage-drop-influence AD to the brightness correction unit 235.

Note that for a display panel having not a sharp change in a border part between regions, spatial smoothing may be performed on the degree of voltage-drop-influence AD calculated by using Formula (8). The case where the spatial smoothing is performed on the degree of voltage-drop-influence AD will be described below. For the case of a mild change of the degree of voltage-drop-influence AD, the image display apparatus 1 employs such a configuration in which the spatial smoothing is performed on the degree of voltage-drop-influence AD. For example, it is possible to use a configuration in which, instead of the degree of voltage-drop-influence AD(x, y), a value obtained by averaging a plurality of degrees of voltage-drop-influence AD(x', y') on regions satisfying $x-m\leq x'<x+m$, $y-n\leq y'<y+n$ (m and n are natural numbers) is employed as a final degree of voltage-drop-influence AD.

(Image Data Correction)

The brightness correction unit 235 refers to the information regarding each pixel 110 determined as a correction-applicable pixel by the correction-applicable-pixel decision unit 215*b* (correction determination information) and the input image data supplied by the image-data acquisition unit 60. In the input image data, the brightness correction unit 235 corrects the R, G, and B gradations of the sub pixels 115, 120, and 125 of the pixel 110 determined as a correction-applicable pixel by the correction-applicable-pixel decision unit 215*b*. The brightness correction unit 235 corrects the R, G, and B gradations of the sub pixels 115, 120, and 125 of the pixel 110 by using a correction-value calculation mapping function described below.

Figure 11:
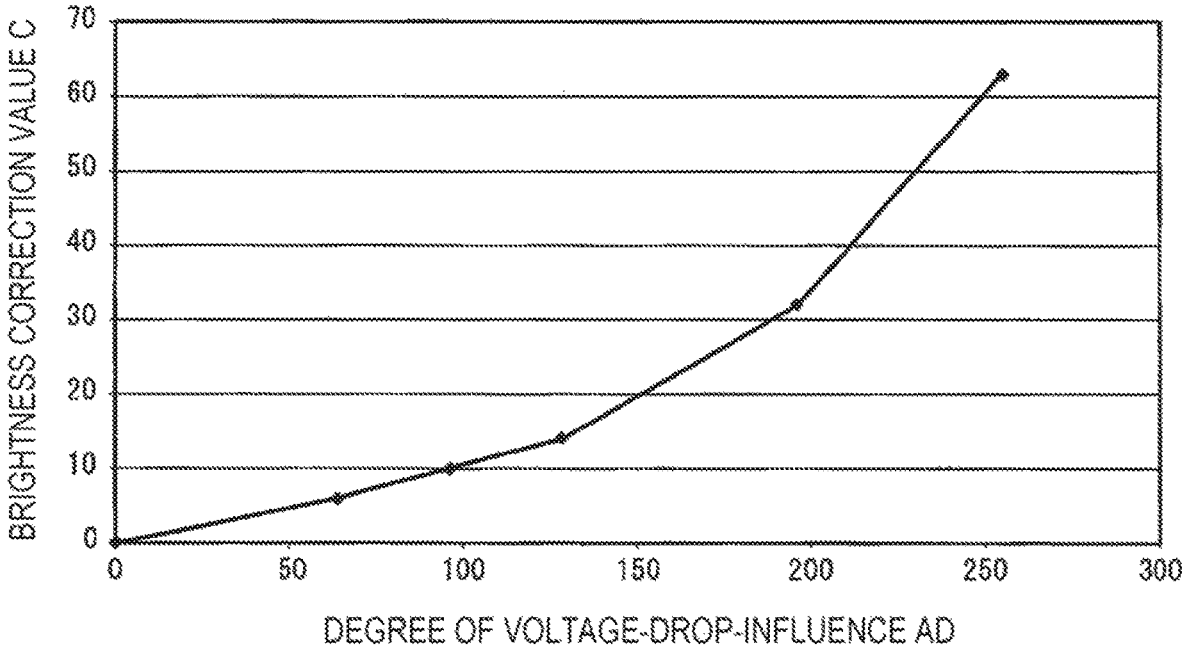
FIG. 11 is a graph illustrating a relationship between a degree of voltage-drop-influence and a brightness correction value.

The relationship between the degree of voltage-drop-influence AD and a brightness correction value C (correction value) is generally expressed as a nonlinear function. The brightness correction unit 235 calculates the brightness correction value C from the degree of voltage-drop-influence AD by using the correction-value calculation mapping function. The correction-value calculation mapping function is expressed as, for example, a function as illustrated in FIG. 11. FIG. 11 is a graph illustrating the relationship between the degree of voltage-drop-influence AD and the brightness correction value C. FIG. 11 illustrates the correction-value calculation mapping function with six points (AD(k), C(k)) (0=k=5). The correction-value calculation mapping function is a function generated in such a manner that the relationship between the degree of voltage-drop-influence AD and the brightness correction value C is in advance calculated. Table 1 describes values of the degree of voltage-drop-influence AD and the brightness correction value C. The values of the degree of voltage-drop-influence AD and the brightness correction value C described in Table 1 are values calculated in advance.

TABLE 1

| | k | 0 | 1 | 2 | 3 | 4 | 5 |
|---|---|---|---|---|---|---|---|
| degree of voltage-drop-influence | AD | 0 | 64 | 96 | 128 | 196 | 255 |
| brightness correction value | C | 0 | 6 | 10 | 14 | 32 | 63 |

Based on the degree of voltage-drop-influence AD calculated by the degree-of-influence calculation unit 230, the brightness correction unit 235 calculates the correction value C for each region resulting from the division by the border selection unit 220*c*. The brightness correction unit 235 corrects the gradations of the sub pixels 115, 120, and 125 based on the correction value C.

If AD(k−1)≤AD≤AD(k) holds true in the value of the degree of voltage-drop-influence AD, the brightness correction value C is calculated by linear interpolation, that is, by using Formula (9) below.

$$C=AD(k-1)+(C(k)-C(k-1))\times(AD-AD(k-1))/(AD(k)-AD(k-1)) \quad (9)$$

The numerical values of AD(k), AD(k−1), C(k), and C(k−1) refer to the numerical values of the degrees of voltage-drop-influence AD and the brightness correction values C described in Table 1. When the brightness correction value C is calculated, the brightness correction unit 235 selects, from Table 1, two values of the degrees of voltage-drop-influence AD close to the value of the degree of voltage-drop-influence AD corresponding to the brightness correction value C and applies the values to Formula (9) described above.

The brightness correction value C is normalized and thereby adjusted to be included in a predetermined numerical value range. For example, a predetermined value is subtracted from or added to the calculated brightness correction value C, and thereby the brightness correction value C is adjusted to be included in the predetermined range. In addition, for the normalization, there is a parameter for performing fine adjustment on the brightness correction value C, and the brightness correction value C may be multiplied by the parameter after the brightness correction value C is determined. The parameter is provided to adjust the influence of the correction in the image data.

In addition, the brightness correction value C has a maximum value (restriction) to prevent image deterioration due to an excessively high brightness correction value C. For example, the maximum value of the brightness correction value C may be set so that a gradation variation due to the correction can be less than or equal to 25% of the maximum gradation. If the gradation variation due to the correction is less than or equal to 25% of the maximum gradation, the gradation variation due to the correction is up to 63 in 256 gradation display (63/256=about 25%).

As described above, the gradations of the sub pixels 115, 120, and 125 included in the pixels 110 are based on R, G, and B. The gradations R1, G1, and B1 of the sub pixels 115, 120, and 125 corrected by the brightness correction unit 235 are respectively expressed by Formula (10) to Formula (12) below.

$$R1=(1+C/256)\times R \quad (10)$$

$$G1=(1+C/256)\times G \quad (11)$$

$$B1=(1+C/256)\times B \quad (12)$$

For example, assume a case where the gradations of the sub pixels 115, 120, and 125 are (R, G, B)=(96, 128, 64) and the correction value is C=8. In this case, the gradation values of the sub pixels 115, 120, and 125 after the correction are respectively, R1=(1+8/256)×96=99, G1=(1+8/256)×128=132, and B1=(1+8/256)×64=66. The gradations of the sub pixels 115, 120, and 125 after the correction by the brightness correction unit 235 thus result in (R1, G1, B1)=(99, 132, 66). The configuration ratio of the gradations of the sub pixels 115, 120, and 125 does not change before and after the correction, and thus the hue is not changed, and only the brightness is enhanced.

The R, G, and B gradations of the sub pixels 115, 120, and 125 of the pixel 110 are corrected in consideration of the influence of the IR drop. The gradations R1, G1, and B1 of the R, G, and B gradations of the sub pixels 115, 120, and 125 of the pixel 110 are thereby corrected to the gradations R1, G1, and B1 to be displayed. Image display quality deterioration due to the IR drop can thus be prevented. The brightness correction unit 235 supplies the corrected image data after the correction to the display unit 10.

Embodiment 2

Another embodiment of the present invention will be described as below. Note that for convenience of explanation, the same members having the same functions as members described in the embodiment above are denoted by the same references, and description thereof is omitted.

The configuration of the brightness correction device 20 is applied to not only the configuration in which one pixel 110 includes the sub pixels 115, 120, and 125 like the configuration of Embodiment 1 but also an image display apparatus employing SPR processing. SPR is an image processing method for displaying a high resolution image with a smaller number of sub pixels than that in the RBG system. In SPR, for example, WQHD 1440×2560 pixels can be displayed by using 960(=1440×⅔)×2560 pixels, and the number of source lines and the number of sub pixels can be reduced. Typical SPR systems include the PenTile system, the RGBDelta system, and the like. Also by the PenTile system and the RGBDelta system, the number of source lines and the number of sub pixels can be reduced to ⅔.

In the PenTile system, a pixel including red and green sub pixels and a pixel including blue and green sub pixels are alternately arranged. The green sub pixel and the blue sub pixel are adjacent to each other. Note that there is a case where in the PenTile system, the green sub pixel of the pixel including the red and green sub pixels and the green sub pixel of the pixel including the blue and green sub pixels are adjacent to each other. Also in the case where the pixels are arranged in this manner, correction can be performed similarly to the RGB system. However, the brightness calculation method needs to be changed depending on the system of SPR.

In the case of the PenTile system, the brightness calculation unit 210 calculates a brightness level PL1 of a pixel including red and green sub pixels by using Formula (13) below. The brightness calculation unit 210 also calculates a brightness level PL2 of a pixel including blue and green sub pixels by using Formula (14) below.

$$PL1=LL\times(\alpha1\times R+\beta1\times G) \quad (13)$$

$$PL2=LL\times(\gamma1\times B+\beta1\times G) \quad (14)$$

PL1 denotes the brightness level of the pixel including the red and green sub pixels, PL2 denotes the brightness level of the pixel including the blue and green sub pixels, R denotes red gradation, G denotes green gradation, and B denotes blue gradation. Setting is performed as $\alpha1+\beta1=\gamma1+\beta1=1$.

The gradations of the red and green sub pixels included in the pixel including the red and green sub pixels are respectively R2 and G2, and the gradations of the blue and green sub pixels included in the pixel including the blue and green sub pixels are respectively B3 and G3. The gradations R4 and G4 of the red and green sub pixels included in the pixel including the red and green sub pixels after the correction by the brightness correction unit 235 are respectively expressed by Formula (15) and Formula (16) below. In addition, the gradations B5 and G5 of the blue and green sub pixels included in the pixel including the blue and green sub pixels after the correction by the brightness correction unit 235 are respectively expressed by Formula (17) and Formula (18) below. C1 and C2 denote brightness correction values.

$$R4=(1+C1/256)\times R2 \quad (15)$$

$$G4=(1+C1/256)\times G2 \quad (16)$$

$$B5=(1+C2/256)\times B3 \quad (17)$$

$$G5=(1+C2/256)\times G3 \quad (18)$$

Embodiment 3

Another embodiment of the present invention will be described as below. Note that for convenience of explanation, the same members having the same functions as members described in the embodiments above are denoted by the same references, and description thereof is omitted.

The RGBDelta system is one of SPR but has sub pixel arrangement different from that in the PenTile system. In the RGBDelta system, the sub pixels are arranged in the order of red, blue, and green for each line of the pixels 110, and sub pixels on a line of the pixels 110 are shifted from a line adjacent to the line. Between the adjacent lines of the pixels 110, a red sub pixel on one of the lines is in contact with green and blue sub pixels on the other line. In addition, a green sub pixel on the line is in contact with the blue sub pixel and a red sub pixel on the other line. Further, a blue sub pixel on the line is in contact with the red sub pixel and a green sub pixel on the other line. The pixels include a pixel including red and green sub pixels, a pixel including blue and red sub pixels, and a pixel including green and blue sub pixels.

In the case of the RGBDelta system, the brightness calculation unit 210 calculates the brightness level PL1 of a pixel including red and green sub pixels by using Formula (12) below. The brightness calculation unit 210 also calculates the brightness level PL2 of a pixel including blue and green sub pixels by using Formula (13) below. On the assumption that one pixel includes three sub pixels, the brightness can be calculated in the RGBDelta system by using Formula (2) that is the same as that in the RGB system not using SPR. In addition, the R, G, and B gradations of the sub pixels can be corrected by using Formula (12) to Formula (10) that are same as those in the case not using SPR. However, the number of pixels in the RGBDelta system is ⅔ of the number of pixels in the RGB system, and thus correction is performed every sub pixels the number of which corresponds to ⅔ of the number of pixels in the RGB system.

Note that in the case of the RGBDelta system, it may be assumed that one pixel includes two sub pixels. In the case where one pixel includes two sub pixels, sub pixel gradations need to be corrected for three pixels that are a pixel including red and green sub pixels, a pixel including blue and red sub pixels, and a pixel including green and blue sub pixels. In addition, coefficients for calculating the brightness need to be defined like the coefficients $\alpha1$, $\beta1$, and $\gamma1$ in Formula (13) and Formula (14).

[Example of Implementation by Software]

The control blocks of the brightness correction device 20 (particularly the brightness calculation unit 210, the correction determination unit 215, the region division unit 220, the regional brightness-level-total calculation unit 225, the degree-of-influence calculation unit 230, and the brightness correction unit 235) may be implemented by a logical circuit (hardware) formed on an integrated circuit (IC chip) or the like or may be implemented by software by using a CPU (Central Processing Unit).

In the latter case, the brightness correction device 20 includes a CPU that executes instructions of a program that is software implementing the functions of the brightness correction device 20, a ROM (read only memory) or a storage device (these are referred to as a recording medium) in which the program and various pieces of data are recorded to be readable by a computer (or the CPU), a RAM (random access memory) into which the program is loaded, and the like. The computer (or the CPU) reads the program from the recording medium and executes the program, and thereby the object of the present invention is achieved. As the recording medium, a "non-transitory tangible medium", such as a tape, a disc, a card, a semiconductor memory, or a programmable logical circuit, may be used. The program may also be provided to the computer via any transmission medium (such as a communication network or a broadcast wave) capable of transmitting the program. Note that an aspect of the present invention may be implemented in a form of a data signal that is embedded in a carrier wave, for which the program is embodied by being electronically transferred.

Note that if high speed processing can be performed, increasing the number of regions resulting from the division by the region division unit 220 enables the accuracy of the brightness correction to be enhanced.

[Summarization]

An image display apparatus 1 according to Aspect 1 of the present invention displays an image on a display unit 10 based on image data. The image display apparatus 1 includes: a region division unit 220 that divides a display surface 105 of the display unit into a plurality of regions; a degree-of-influence calculation unit 230 that calculates a first degree of influence (a degree of voltage-drop-influence AD) representing a degree of influence of a brightness level of each of the regions on a brightness level of a respective region adjacent to the region, the regions resulting from the division by the region division unit; and a brightness correction unit 235 that corrects a brightness level of each of pixels 110 in the image data based on the first degree of influence. Influence of not only a location of connection in wiring in the display unit with an input terminal of a power supply for the display unit but also a wiring configuration of the display unit is reflected on the first degree of influence.

According to the configuration described above, the brightness correction unit corrects the brightness level of each of the pixels in the image data based on the first degree of influence representing the degree of influence of the brightness level of each of the plurality of regions on the brightness level of the respective region adjacent to the region. In addition, the influence of not only the location of connection in the wiring in the display unit with the input terminal of the power supply for the display unit but also the wiring configuration of the display unit is reflected on the first degree of influence. This enables the brightness level of the pixel in the image data to be corrected appropriately regardless of the location of the connection in the wiring in the display unit with the input terminal of the power supply for the display unit or the wiring configuration of the display unit.

In Aspect 1 described above, in the image display apparatus 1 according to Aspect 2 of the present invention, the region division unit 220 includes: a brightness-level-total calculation unit 220*a* that calculates totals of brightness levels of the pixels, the totals being calculated for respective lines of the pixels 110 on the display surface 105; and a difference calculation unit 220*b* that calculates differences in the totals of the brightness levels between mutually adjacent lines of the pixels. The region division unit 220 may select a difference that is more than or equal to a first threshold and the number of which is not more than a predetermined number from a highest difference among the differences calculated by the difference calculation unit 220*b*, and set a border between the lines of the pixels corresponding to the selected difference to a border for the division.

According to the configuration described above, the difference calculation unit calculates the differences in the totals of the brightness levels between the mutually adjacent lines of the pixels. In addition, the region division unit selects the difference that is more than or equal to the first threshold and the number of which is not more than the predetermined number from the highest difference among the differences calculated by the difference calculation unit and sets the border between the lines of the pixels corresponding to the selected difference. The difference the number of which is the predetermined number is selected from the highest difference among the differences, and the border between the lines of the pixels corresponding to the selected difference is set to the border for the division. Accordingly, the brightness level of each pixel in each region resulting from the division by the region division unit becomes relatively uniform. In addition, since the region having the relatively uniform brightness-level pixels can be extracted, correction common to the pixels in the region can be applied, for example, on a per region basis.

In Aspect 1 or 2 described above, the image display apparatus 1 according to Aspect 3 of the present invention further includes: a memory unit (base parameter memory unit 240) that stores a second degree of influence (degree of influence BP) representing a degree of influence of a brightness level of each of a plurality of uniform regions on a brightness level of a respective region adjacent to the region in a state where the uniform regions result from division performed on the display surface 105 of the display unit 10; and a regional brightness-level-total calculation unit 225 that calculates totals of the brightness levels of the pixels 110 in each region resulting from the division by the region division unit 220. The degree-of-influence calculation unit 230 may calculate the first degree of influence (degree of voltage-drop-influence AD) based on each of the totals calculated by the regional brightness-level-total calculation unit and the second degree of influence on one of the plurality of uniform regions that includes a pixel in a center of the region resulting from the division by the region division unit.

According to the configuration described above, the degree-of-influence calculation unit calculates the first degree of influence based on each total of the brightness levels of the pixels in the corresponding region resulting from the division by the region division unit and the second degree of influence on one of the plurality of uniform regions that includes the pixel in the center of the region resulting from the division by the region division unit.

Note that the second degree of influence represents the degree of influence of the brightness level of each region that is one region of the plurality of uniform regions on the brightness level of the respective region adjacent to the region. The first degree of influence represents the degree of influence of the brightness level of each region resulting from the division by the region division unit on the brightness level of the respective region adjacent to the region. The regions resulting from the division by the region division unit are not necessarily uniform regions. The first degree of influence is thus calculated by the degree-of-influence calculation unit more easily than in the case where the first degree of influence is directly calculated from the region resulting from the division by the region division unit. This can reduce a processing amount for calculating the first degree of influence. Accordingly, the burden on processing by the image display apparatus can be reduced, and cost can thus be reduced.

In addition, the first degree of influence is calculated based on the second degree of influence on one of the plurality of uniform regions that includes the pixel in the center of the region resulting from the division by the region division unit, and thereby the brightness level of each pixel in the image data can be corrected appropriately.

In any one of Aspects 1 to 3 described above, in the image display apparatus 1 according to Aspect 4 of the present invention, the brightness correction unit 235 may calculate a correction value (brightness correction value C) for correcting the brightness level of each of the pixels 110 in the image data based on the first degree of influence (degree of voltage-drop-influence AD) and correct gradations of sub pixels 115, 120, and 125 included in the pixel in the image data based on the correction value.

According to the configuration described above, the correction value for correcting the brightness level of each of the pixels in the image data is calculated based on the first degree of influence, and the gradations of the sub pixels included in the pixel in the image data is corrected based on the correction value. In addition, the influence of not only the location of the connection in the wiring in the display unit with the input terminal of the power supply for the display unit but also the wiring configuration of the display unit is reflected on the first degree of influence. This enables the gradation of each sub pixel in the image data to be corrected appropriately regardless of the location of the connection in the wiring in the display unit with the input terminal of the power supply for the display unit or the wiring configuration of the display unit.

In addition, the gradation of each sub pixel included in the pixel in the image data is corrected based on the correction value for correcting the brightness level of the pixel in the image data based on the first degree of influence representing the degree of influence of the brightness level of each region on the brightness level of the respective region adjacent to the region. It is thereby possible to prevent the lowering of the brightness level of the region caused by the brightness level of the respective region adjacent to the region.

In Aspect 2 described above, in the image display apparatus 1 according to Aspect 5 of the present invention, the display unit 10 may display an image for each of frames, and the brightness correction unit 235 may correct a brightness level of each of pixels in image data in a target frame in a case where the image data regarding a most recent frame represents a still image and where image data regarding frames from a frame three frames before the target frame to the target frame consecutively represents a still image, each of the still images being represented by the corresponding image data, if a maximum value of a difference between a location of a border in the most recent frame between the regions resulting from the division by the region division unit 220 and a location of a border in a frame one frame before the most recent frame between the regions resulting from the division by the region division unit is less than a second threshold, and if a difference between a maximum value of the differences calculated by the difference calculation unit 220*b* for the most recent frame and a maximum value of the differences calculated by the difference calculation unit for the frame one frame before the most recent frame is less than a third threshold.

According to the configuration described above, in a frame and a succeeding frame, if the maximum value of the difference in the location of the border between the regions resulting from the division by the region division unit is less than the second threshold, and if the maximum value of the differences calculated by the difference calculation unit is less than the third threshold, the image data regarding the most recent frame represents a still image. In addition, in the case where the image data regarding the frames from the frame three frames before the target frame to the target frame consecutively represents the still image, the brightness correction unit corrects the brightness level of the pixel in the image data of the target frame. Image data having a slight image change in a frame and a succeeding frame, for example, like a still image can thereby be decided as a correction target.

In Aspect 3 described above, the image display apparatus 1 according to Aspect 6 of the present invention may further include a brightness calculation unit 210 that calculates the brightness level of each of the pixels 110 in the image data based on the gradations of the sub pixels 115, 120, and 125 included in the pixel in the image data.

According to the configuration described above, the brightness calculation unit calculates the brightness level of each of the pixels in the image data based on the gradations of the sub pixels included in the pixel in the image data. In addition, the degree-of-influence calculation unit calculates the first degree of influence based on the total of the brightness levels of the pixels in each region. The first degree of influence is thereby calculated not based on the gradations of the sub pixels but based on the brightness level of the pixel calculated based on the gradations of the sub pixels. Accordingly, the brightness of the pixel in the image data can be corrected without changing the hue.

The present invention is not limited to the embodiments described above. Various modifications may be made within the scope of claims. An embodiment obtained by appropriately combining technical measures disclosed in different embodiments is also included in the technical scope of the present invention. Further, a new technical feature may be formed by combining technical measures disclosed in the embodiments.

REFERENCE SIGNS LIST

1 image display apparatus
2 characteristic extraction apparatus
10 display unit
20 brightness correction device
30 brightness adjustment unit
40 region uniform-division unit
50 base-parameter calculation unit
60 image-data acquisition unit
105 display surface
110, A1, B1 pixel
115, 120, 125 sub pixel
210 brightness calculation unit
215 correction determination unit
215*a* correction-target-frame determination unit
215*b* correction-applicable-pixel decision unit
220 region division unit
220*a* brightness-level-total calculation unit
220*b* difference calculation unit
220*c* border selection unit
225 regional brightness-level-total calculation unit
230 degree-of-influence calculation unit
235 brightness correction unit
240 base parameter memory unit (memory unit)
D1 terminal
P1, P2, P3, P4, P5, P6, P7 region
PL1, PL2 brightness level
R0, Rx, Ry resistor
S1 part

The invention claimed is:

1. An image display apparatus that displays an image on a display unit based on image data, comprising:

a region division unit that divides a display surface of the display unit into a plurality of regions;

a degree-of-influence calculation unit that calculates a first degree of influence representing a degree of influence of a brightness level of each of the regions on a brightness level of a respective region adjacent to the region, the regions resulting from the division by the region division unit; and a brightness correction unit that corrects a brightness level of each of pixels in the image data based on the first degree of influence, wherein influence of not only a location of connection in wiring in the display unit with an input terminal of a power supply for the display unit but also a wiring configuration of the display unit is reflected on the first degree of influence, wherein the region division unit includes:

a brightness-level-total calculation unit that calculates totals of brightness levels of the pixels, the totals being calculated for respective lines of the pixels on the display surface; and a difference calculation unit that calculates differences in the totals of the brightness levels between mutually adjacent lines of the pixels, and wherein the region division unit selects a difference that is more than or equal to a first threshold and the number of which is not more than a predetermined number from a highest difference among the differences calculated by the difference calculation unit, and the region division unit sets a border between the lines of the pixels corresponding to the selected difference to a border for the division.

2. The image display apparatus according to claim 1, further comprising:

a memory unit that stores a second degree of influence representing a degree of influence of a brightness level of each of a plurality of uniform regions on a brightness level of a respective region adjacent to the region in a state where the uniform regions result from division performed on the display surface of the display unit; and a regional brightness-level-total calculation unit that calculates totals of the brightness levels of the pixels in each region resulting from the division by the region division unit, wherein the degree-of-influence calculation unit calculates the first degree of influence based on each of the totals calculated by the regional brightness-level-total calculation unit and the second degree of influence on one of the plurality of uniform regions that includes a pixel in a center of the region resulting from the division by the region division unit.

3. The image display apparatus according to claim 1, wherein the brightness correction unit calculates a correction value for correcting the brightness level of each of the pixels in the image data based on the first, degree of influence and corrects gradations of sub pixels included in the pixel in the image data based on the correction value.

4. The image display apparatus according to claim 1, wherein the display unit displays an image for each of frames, and wherein the brightness correction unit corrects a brightness level of each of pixels in image data in a target frame in a case where the image data regarding a most recent frame represents a still image and where image data regarding frames from a frame three frames before the target frame to the target frame consecutively represents a still image, each of the still images being represented by the corresponding image data, if a maximum value of a difference between a location of a border in the most recent frame between the regions resulting from the division by the region division unit and a location of a border in a frame one frame before the most recent frame between the regions resulting from the division by the region division unit is less than a second threshold, and if a difference between a maximum value of the differences calculated by the difference calculation unit for the most recent frame and a maximum value of the differences calculated by difference calculation unit for the frame one frame before the most recent frame is less than a third threshold.

5. The image display apparatus according to claim 2, further comprising a brightness calculation unit that calculates the brightness level of each of the pixels in the image data based on the gradations of the sub pixels included in the pixel in the image data.

* * * * *